US010392973B2

(12) United States Patent
Honda et al.

(10) Patent No.: US 10,392,973 B2
(45) Date of Patent: Aug. 27, 2019

(54) POSITIONING DEVICE, ROTARY MACHINE COMPRISING SAME, AND POSITIONING METHOD

(71) Applicant: MITSUBISHI HITACHI POWER SYSTEMS, LTD., Kanagawa (JP)

(72) Inventors: Shinya Honda, Tokyo (JP); Akihiko Shirota, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 620 days.

(21) Appl. No.: 15/102,392

(22) PCT Filed: Dec. 17, 2014

(86) PCT No.: PCT/JP2014/083438

§ 371 (c)(1),
(2) Date: Jun. 7, 2016

(87) PCT Pub. No.: WO2015/093536

PCT Pub. Date: Jun. 25, 2015

(65) Prior Publication Data

US 2016/0305287 A1 Oct. 20, 2016

(30) Foreign Application Priority Data

Dec. 19, 2013 (JP) ..... 2013-262891

(51) Int. Cl.
*F01D 25/24* (2006.01)
*F01D 25/26* (2006.01)
*F01D 9/04* (2006.01)

(52) U.S. Cl.
CPC ..... *F01D 25/246* (2013.01); *F01D 9/041* (2013.01); *F01D 25/26* (2013.01);
(Continued)

(58) Field of Classification Search
CPC ..... F01D 25/24; F01D 25/243; F01D 25/246; F01D 25/26; F01D 25/265; F05D 2230/64; F05D 2230/644
See application file for complete search history.

(56) References Cited

U.S. PATENT DOCUMENTS 7,581,922 B1 * 9/2009 Morimoto ..... F01D 25/26 415/126
2012/0099990 A1 * 4/2012 Fretwell ..... F01D 25/246 416/131

FOREIGN PATENT DOCUMENTS

DE 4230235 3/1994
JP 61-17104 1/1986
(Continued)

OTHER PUBLICATIONS

Office Action dated Feb. 7, 2017 in corresponding Japanese patent application No. 2015-553585 (with English translation).
(Continued)

*Primary Examiner* — Richard A Edgar
(74) *Attorney, Agent, or Firm* — Wenderoth, Lind & Ponack, L.L.P.

(57) ABSTRACT

A pin insertion hole penetrating an outer member from an outer circumferential side to an inner circumferential side is formed in the outer member. A pin groove that is concave from an outer circumferential side to an inner circumferential side is formed in an inner member. A positioning device includes a pin that is inserted into the pin insertion hole of the outer member and the pin groove of the inner member, a liner holder that comes in contact with a groove side surface of the pin groove, and a liner that is disposed between the liner holder and the pin in the pin groove.

15 Claims, 18 Drawing Sheets

(52) U.S. Cl.
CPC ..... *F05D 2220/31* (2013.01); *F05D 2230/64* (2013.01); *F05D 2230/644* (2013.01); *F05D 2240/128* (2013.01); *F05D 2240/14* (2013.01)

(56) References Cited

FOREIGN PATENT DOCUMENTS

| | | |
|---|---|---|
| JP | 2000-345810 | 12/2000 |
| JP | 2004-076738 | 3/2004 |
| JP | 2004-162536 | 6/2004 |
| JP | 2006-316749 | 11/2006 |
| JP | 2007-154871 | 6/2007 |
| JP | 2007-154885 | 6/2007 |
| JP | 4333896 | 9/2009 |
| JP | 2014-66174 | 4/2014 |
| JP | 2014066174 A * | 4/2014 |

OTHER PUBLICATIONS

International Search Report (ISR) dated Mar. 24, 2015 in corresponding International Application No. PCT/JP2014/083438 (with English translation).
Written Opinion of the International Searching Authority dated Mar. 24, 2015 in corresponding International Application No. PCT/JP2014/083438 (with English translation).

* cited by examiner

POSITIONING DEVICE, ROTARY MACHINE COMPRISING SAME, AND POSITIONING METHOD

BACKGROUND OF THE INVENTION

1. Technical Field

The present invention relates to a positioning device that positions an inner member, which is disposed on an inner circumferential side of an outer member and extends in a circumferential direction around an axis, with respect to the outer member, which extends in the circumferential direction around the axis, a rotary machine having the positioning device, and a positioning method. Priority is claimed on Japanese Patent Application No. 2013-262891, filed Dec. 19, 2013, the content of which is incorporated herein by reference.

2. Description of the Related Art

A rotary machine, such as a steam turbine, a gas turbine, or a compressor, includes a rotor shaft, an outer member such as a casing which extends in a circumferential direction around the rotor shaft, and an inner member that is disposed on an inner circumferential side of the outer member and extends in the circumferential direction around the rotor shaft. In such a rotary machine, a positioning device may be used to position the inner member relative to the rotor shaft which has been positioned relative to the outer member.

An example of such a positioning device is disclosed in Japanese Unexamined Utility Model Application, Publication No. S61-017104. The positioning device includes a radial pin that is inserted into a pin insertion hole of a casing as the outer member and a groove of a blade ring as the inner member, a liner that is disposed between a tip of the radial pin and a groove side surface of the groove, and a bolt that fixes the liner to the tip of the radial pin. A groove contact surface coming in contact with the groove side surface and a pin contact surface coming in contact with the tip of the radial pin are formed in the liner. A screw insertion hole which penetrates the liner from the groove contact surface to the pin contact surface and into which a threaded portion of the bolt is inserted and a bolt head receiving recess that communicates with the screw insertion hole and receives the bolt head of the bolt are formed in the liner.

SUMMARY OF THE INVENTION

1. Technical Problem

In the technique described in JP Publication No. S61-017104, a specific liner in which a gap dimension between the groove contact surface and the pin contact surface has been adjusted needs to be separately manufactured or a plurality of liners having different gap dimensions between the groove contact surface and the pin contact surface need to be prepared in advance in order to position the inner member relative to the rotor shaft which has been positioned relative to the outer member. It is necessary to form the screw insertion hole and the bolt head receiving recess in the liner described in JP Publication No. S61-017104. Accordingly, in the technique described in JP Publication No. S61-017104, whether a specific liner is separately manufactured or a plurality of liners are prepared in advance as described above, there is a problem in that the manufacturing cost of the positioning device increases.

Therefore, the present invention is made in consideration of the problem in the background art and an object thereof is to provide a technique capable of suppressing an increase in the manufacturing cost of a positioning device.

2. Solution to the Problem

In order to achieve the above-mentioned object, according to an aspect of the present invention, there is provided a positioning device that positions an inner member, which is disposed on an inner circumferential side of an outer member and extends in a circumferential direction around an axis, relative to the outer member, which extends in the circumferential direction around the axis, the positioning device including: a pin that is inserted into a pin insertion hole and a groove, the pin insertion hole penetrating the outer member from an outer circumferential side of the outer member to the inner circumferential side of the outer member, and the groove being concave from an outer circumferential side of the inner member to an inner circumferential side of the inner member; a liner holder that comes in contact with a groove side surface of the groove; and a liner that is disposed between the liner holder and the pin in the groove.

Since the positioning device includes the liner holder, it is not necessary to form a bolt head receiving recess (or a screw head receiving recess) that receives a head of a bolt (or a screw) fixing the liner to the pin. Accordingly, even when a plurality of liners having different thicknesses are prepared in advance, it is possible to suppress an increase in the manufacturing cost of the positioning device.

In the positioning device, the pin may include an insertion portion that is inserted into the pin insertion hole of the outer member and a groove insertion portion that is inserted into the groove of the inner member; the liner holder may include a first liner holder that is disposed between a first groove side surface of a pair of groove side surfaces facing each other in the groove and the groove insertion portion of the pin, and a second liner holder that is disposed between a second groove side surface of the pair of groove side surfaces and the groove insertion portion of the pin; and the liner may be disposed in at least one space of a space between the groove insertion portion and the first liner holder and a space between the groove insertion portion and the second liner holder.

The positioning device including the pin having the groove insertion portion may further include a liner fitting that fixes the liner holder and the liner to the groove insertion portion of the pin.

In the positioning device including the liner fitting, the liner fitting may be a fixing screw that includes a cylindrical threaded portion and a screw head disposed at an end of the threaded portion; a screw hole into which the threaded portion of the fixing screw is screwed may be formed in the groove insertion portion of the pin; a screw insertion portion into which the threaded portion of the fixing screw is inserted may be formed in the liner; and a screw insertion portion into which the threaded portion of the fixing screw is inserted and a screw head receiving recess which communicates with the screw insertion portion and into which the screw head of the fixing screw is received may be formed in the liner holder.

In any one of the positioning devices including the pin having the groove insertion portion, a pair of liner contact surfaces that face opposite sides and engaging portions having a concave shape or a convex shape with respect to the pair of liner contact surfaces may be formed in the groove insertion portion of the pin; and a groove contact surface that comes in contact with the groove side surface, a liner contact surface that faces the opposite side from the side which the groove contact surface faces, and an engaged portion that has a convex shape or a concave shape with respect to the liner contact surface to engage with the engaging portion, may be formed in the liner holder.

In the positioning device, the liner holder can be easily and accurately attached to a predetermined position of the pin.

In the positioning device in which the engaging portion is formed in the pin, the engaging portion of the pin may include a pair of first engaging portions that are concave or convex with respect to the liner contact surface of the pin, are long along the liner contact surface in an insertion direction in which the pin is inserted into the pin insertion hole, and are formed with a gap therebetween in a direction perpendicular to the insertion direction; the engaged portion of the liner holder may include a pair of first engaged portions that are convex or concave with respect to the liner contact surface of the liner holder, are long in the insertion direction, are formed with a gap therebetween in the direction perpendicular to the insertion direction, and respectively engage with the pair of first engaging portions; and the liner may be disposed between the pair of first engaging portions.

With the positioning device, it is possible to reduce the contact of a fluid with the liner even in a rotary machine in which the fluid flows. Accordingly, for example, even when the liner is corroded with the fluid, it is possible to suppress the corrosion.

In any one of the positioning devices in which the engaging portion is formed in the pin, the engaging portion of the pin may include a second engaging portion that is concave or convex with respect to the liner contact surface of the pin and is long along the liner contact surface in an insertion direction in which the pin is inserted into the pin insertion hole; and the engaged portion of the liner holder may include a second engaged portion that is convex or concave with respect to the liner contact surface of the liner holder, is long in the direction perpendicular to the insertion direction, and engages with the second engaging portion.

In the positioning device, it is possible to regulate movement of the liner holder relative to the pin in the insertion direction. Accordingly, in the positioning device, it is possible to prevent the liner holder from remaining in the pin groove when detaching the pin from the pin groove and the pin insertion hole.

In any one of the positioning devices in which the engaging portion is formed in the groove insertion portion of the pin, the liner may be disposed at a position other than that of the engaging portion of the groove insertion portion and that of the engaged portion of the liner holder between the groove insertion portion of the pin and the liner holder.

In the positioning device, the liner is not likely to stick to the groove insertion portion of the pin and the liner can be easily detached from the pin when the positioning device is detached.

In any one of the positioning devices including the pin having the groove insertion portion, a concave portion that communicates with the pin insertion hole, has a diameter larger than that of the pin insertion hole, and is concave from the outer circumferential side of the outer member to the inner circumferential side may be formed on the outer circumferential side of the outer member; the positioning device may further include a seal member that seals a space between the outer member and the pin; the pin may include a head flange that is formed on the opposite side of the insertion portion from the groove insertion portion in an insertion direction in which the pin is inserted into the pin insertion hole, has a diameter larger than the diameter of the insertion portion, and is capable of being received in the concave portion; and the seal member may be disposed between the head flange of the pin and a bottom surface of the concave portion.

In the positioning device, it is possible to prevent a fluid from leaking from the pin insertion hole of the outer member even in a rotary machine in which the fluid flows.

In any one of the positioning devices including the pin having the groove insertion portion, the pin insertion hole of the outer member may be a cylindrical hole; the insertion portion of the pin may have a cylindrical shape; the groove insertion portion may include a side circumferential surface that is a circumferential surface extending from a part of an outer circumferential surface of the cylindrical insertion portion and a surface which is located inside a virtual outer circumferential surface extending from the outer circumferential surface of the insertion portion and to which the liner holder is fixed; and the liner holder may be located inside the virtual outer circumferential surface when the liner holder is fixed to the groove insertion portion.

In the positioning device, it is possible to easily insert the pin, in which the liner holder is fixed to the groove insertion portion, into the cylindrical pin insertion hole.

In any one of the positioning devices, a concave portion that communicates with the pin insertion hole and is concave from the outer circumferential side of the outer member to the inner circumferential side may be formed on the outer circumferential side of the outer member, and a female thread may be formed on the side circumferential surface of the concave portion; and the positioning device may further include a pin holding screw that is screwed into the female thread and comes in contact with the head of the pin.

In the positioning device, it is possible to prevent the pin from dropping from the pin insertion hole. In the positioning device, when detaching the pin inserted into the pin insertion hole, it is possible to simply detach the pin by loosening the pin holding screw and detaching the pin holding screw.

The positioning device including the pin holding screw may further include a locking tool that engages with a part of the pin holding screw, engages with a part of the outer member, and regulates rotation in a loosening direction of the pin holding screw from the female thread.

In the positioning device, it is possible to regulate looseness of the pin holding screw. Accordingly, it is possible to prevent the pin from dropping due to dropping of the pin holding screw.

In order to achieve the above-mentioned object, according to an aspect of the present invention, there is provided a rotary machine including: any one of the above-described positioning devices; the outer member; the inner member; and a rotor that is disposed on the inner circumferential side of the inner member and rotates around the axis.

In this case, the rotor may be a steam turbine rotor. That is, the rotary machine may be a steam turbine.

In order to achieve the above-mentioned object, according to an aspect of the present invention, there is provided a positioning method of positioning an inner member relative to an outer member using any one of the above-described positioning devices, the positioning method including: a temporary positioning step of temporarily positioning the inner member relative to the outer member using a temporary positioning device including a temporary pin that is inserted into a pin insertion hole of the outer member and a groove of the inner member; a displacement measuring step of measuring a displacement of the temporarily-positioned inner member relative to the outer member; an adjusted pin assembling step of assembling an adjusted pin which is adjusted by disposing a liner having a thickness corresponding to the displacement between the pin and a liner holder in the positioning device; a temporary holding step of temporarily holding the inner member so as to be movable relative to the outer member; a temporary position releasing step of extracting the temporary positioning device from the outer member and the temporarily-held inner member; a positioning device attaching step of inserting the adjusted pin into the pin insertion hole of the outer member and the groove of the inner member; and a temporary hold releasing step of releasing the temporary holding of the inner member after the positioning device attaching step.

In order to achieve the above-mentioned object, according to another aspect of the present invention, there is provided a positioning method of positioning an inner member, which is disposed on an inner circumferential side of an outer member and extends in a circumferential direction around an axis, relative to the outer member, which extends in the circumferential direction around the axis, the positioning method including: a preparing step of preparing a positioning device including a pin that is inserted into a pin insertion hole penetrating the outer member from an outer circumferential side of the outer member to the inner circumferential side and a groove concave from an outer circumferential side of the inner member to an inner circumferential side, a liner holder that comes in contact with a groove side surface of the groove, and a liner that is disposed between the liner holder and the pin in the groove; a temporary positioning step of temporarily positioning the inner member relative to the outer member using a temporary positioning device including a temporary pin that is inserted into the pin insertion hole of the outer member and the groove of the inner member; a displacement measuring step of measuring a displacement of the temporarily-positioned inner member relative to the outer member; an adjusted pin assembling step of assembling an adjusted pin which is adjusted by disposing the liner having a thickness corresponding to the displacement between the pin and the liner holder in the positioning device; a temporary holding step of temporarily holding the inner member so as to be movable relative to the outer member; a temporary position releasing step of extracting the temporary positioning device from the outer member and the temporarily-held inner member; a positioning device attaching step of inserting the adjusted pin into the pin insertion hole of the outer member and the groove of the inner member; and a temporary hold releasing step of releasing the temporary holding of the inner member after the positioning device attaching step.

In the positioning method in which the preparing step is performed, the preparing step may include preparing a plurality of liners having different thicknesses as the liner; and the adjusted pin assembling step may include selecting the liner having the thickness corresponding to the displacement measured in the displacement measuring step out of the plurality of liners and disposing the selected liner between the pin and the liner holder.

In any one of the positioning methods in which the preparing step is performed, the preparing step may include preparing a seal member that seals a space between the outer member and the pin and a pin holding screw that is screwed into a position at which the pin insertion hole is formed in the outer member from the outer circumferential side of the outer member; and the positioning device attaching step may include sealing the space between the outer member and the pin with the seal member, inserting the adjusted pin into the pin insertion hole of the outer member and the groove of the inner member, screwing the pin holding screw into the position at which the pin insertion hole is formed in the outer member, and bringing the pin holding screw into contact with the adjusted pin.

3. Advantageous Effects of the Invention

According to an aspect of the present invention, it is possible to suppress an increase in the manufacturing cost of a positioning device.

DETAILED DESCRIPTION OF EMBODIMENTS

Hereinafter, an embodiment of a positioning device according to the present invention and a rotary machine having the positioning device and modified examples of the positioning device will be described in detail with reference to the accompanying drawings.

Embodiment

First, the embodiment of the positioning device according to the present invention and the rotary machine having the positioning device will be described with reference to FIGS. 1 to 16.

Figure 1:
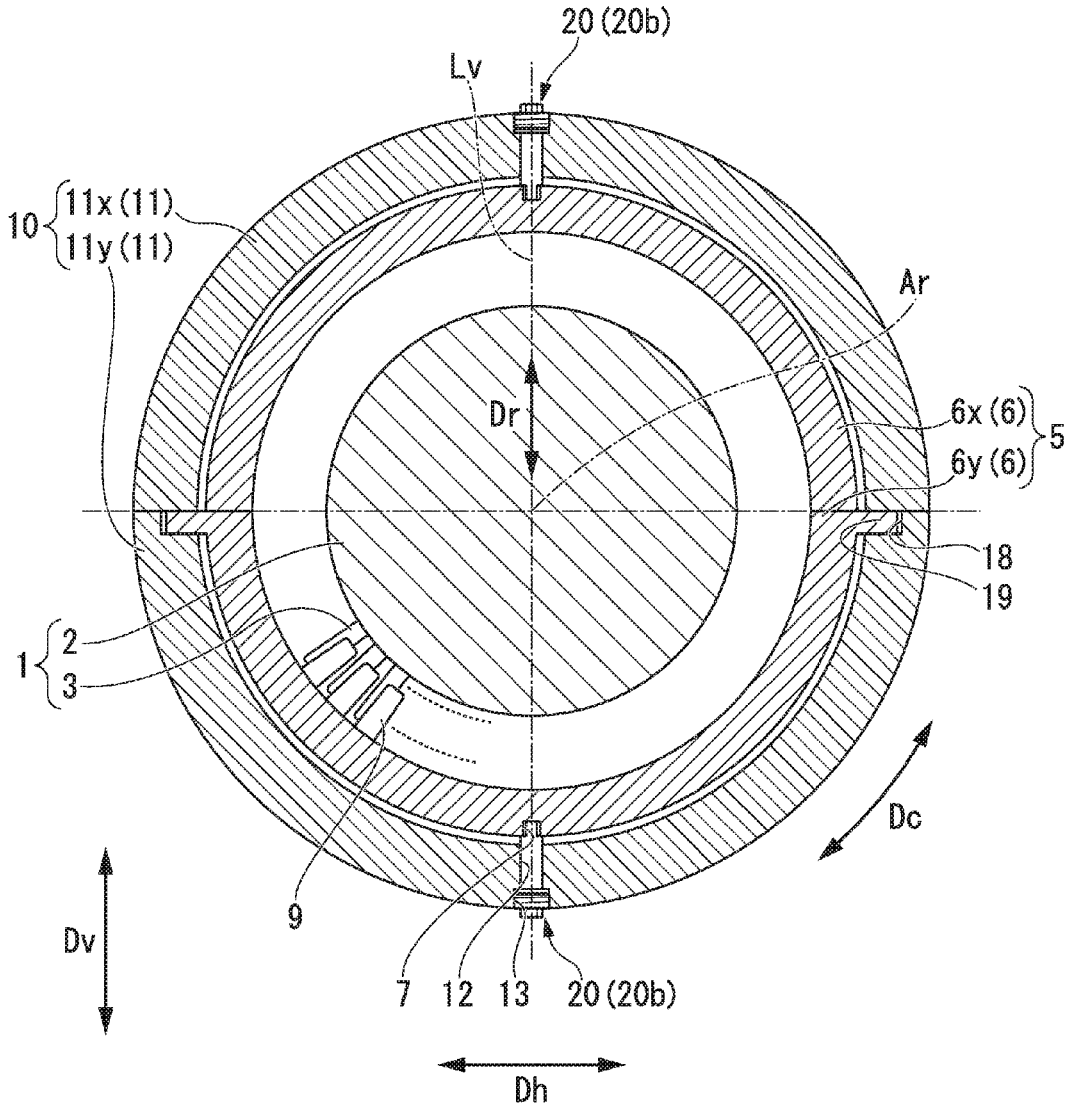
FIG. 1 is a cross-sectional view of a rotary machine according to an embodiment of the present invention.

A rotary machine according to this embodiment is a steam turbine. As shown in FIG. 1, the steam turbine includes a rotor (a steam turbine rotor) 1 that rotates around an axis Ar, a blade ring 5 that is disposed on an outer circumferential side of the rotor 1 and forms a ring shape around the axis Ar, a casing 10 that is disposed on an outer circumferential side of the blade ring 5 and forms a ring shape around the axis Ar, and a positioning device 20 that positions the blade ring 5 relative to the casing 10. Hereinafter, a direction in which the axis Ar extends is referred to as an axial direction Da, a radial direction with respect to the axis Ar is simply referred to as a radial direction Dr, and a circumferential direction around the axis Ar is simply referred to as a circumferential direction Dc. A direction which is perpendicular to the axis Ar and which is horizontal is referred to as a horizontal direction Dh, and a direction which is perpendicular to the axis Ar and which is vertical is referred to as a vertical direction Dv.

The rotor 1 includes a rotor shaft 2 that extends in the axial direction Da around the axis Ar and a plurality of blades 3 that are arranged in the circumferential direction Dc and are fixed to the rotor shaft 2. The annular blade ring 5 is provided with a plurality of vanes 9, which are arranged in the circumferential direction Dc, at positions on an inner circumferential side of the blade ring 5 and upstream from the blades 3 of the rotor 1. In the steam turbine, a tubular space between the outer circumferential side of the rotor shaft 2 and the inner circumferential side of the annular blade ring 5, that is, a space in which the blades 3 and the vanes 9 are arranged, serves as a steam channel. The annular blade ring 5 includes an upper-half blade ring 6*x* on the upper side of the axis Ar and a lower-half blade ring 6*y* on the lower side. The upper-half blade ring 6*x* and the lower-half blade ring 6*y* each form a semicircular shape with respect to the axis Ar and are connected to each other at ends in the circumferential direction Dc with bolts or the like. The annular casing 10 includes an upper-half casing 11*x* on the upper side of the axis Ar and a lower-half casing 11*y* on the lower side. The upper-half casing 11*x* and the lower-half casing 11*y* each form a semicircular shape with respect to the axis Ar and are connected to each other at ends in the circumferential direction Dc with bolts or the like.

A groove 18 that is concave from the inner circumferential side to the outer circumferential side is formed at the ends in the circumferential direction Dc of the lower-half casing 11*y*. A protrusion 19 that protrudes to the outer circumferential side is formed at the ends in the circumferential direction Dc of the lower-half blade ring 6*y*, and the protrusion 19 is fitted to the groove 18. By fitting of the protrusion 19 to the groove 18, the lower-half blade ring 6*y* is constrained so as not to be movable in the vertical direction Dv and the axial direction Da relative to the lower-half casing 11*y*. A protrusion (not shown) that protrudes to the inner circumferential side is formed on the inner circumferential surface of the lower-half casing 11*y* over the entire circumference in the circumferential direction Dc, while a groove (not shown) that is concave to the inner circumferential side over the entire circumference in the circumferential direction Dc is formed on the outer circumferential surface of the lower-half blade ring 6*y*, and the protrusion is fitted to the groove over the entire circumference. Accordingly, the lower-half blade ring 6*y* is constrained so as not to be movable in the axial direction Da relative to the lower-half casing 11*y*. The same fitting portions in the circumferential direction are formed in the upper-half casing 11*x* and the upper-half blade ring 6*x*. When the positioning device 20 is not set, the lower-half blade ring 6*y* is movable relative to the lower-half casing 11*y* in the horizontal direction Dh. When the positioning device 20 is not set, the upper-half blade ring 6*x* is movable relative to the upper-half casing 11*x* in the horizontal direction Dh.

In this embodiment, the upper-half blade ring 6*x* and the lower-half blade ring 6*y* constitute the inner member, and the upper-half casing 11*x* and the lower-half casing 11*y* constitute the outer member. Hereinafter, the upper-half blade ring 6*x* and the lower-half blade ring 6*y* may be simply referred to as half blade rings 6, and the upper-half casing 11*x* and the lower-half casing 11*y* may be simply referred to as half casings 11.

As the positioning device 20, a lower positioning device 20 that positions the lower-half blade ring 6*y* relative to the lower-half casing 11*y* and an upper positioning device 20 that positions the upper-half blade ring 6*x* relative to the upper-half casing 11*x* are provided. The upper positioning device 20 and the lower positioning device 20 have the same structure. Accordingly, the lower positioning device 20 will be described mainly below.

Figure 2:
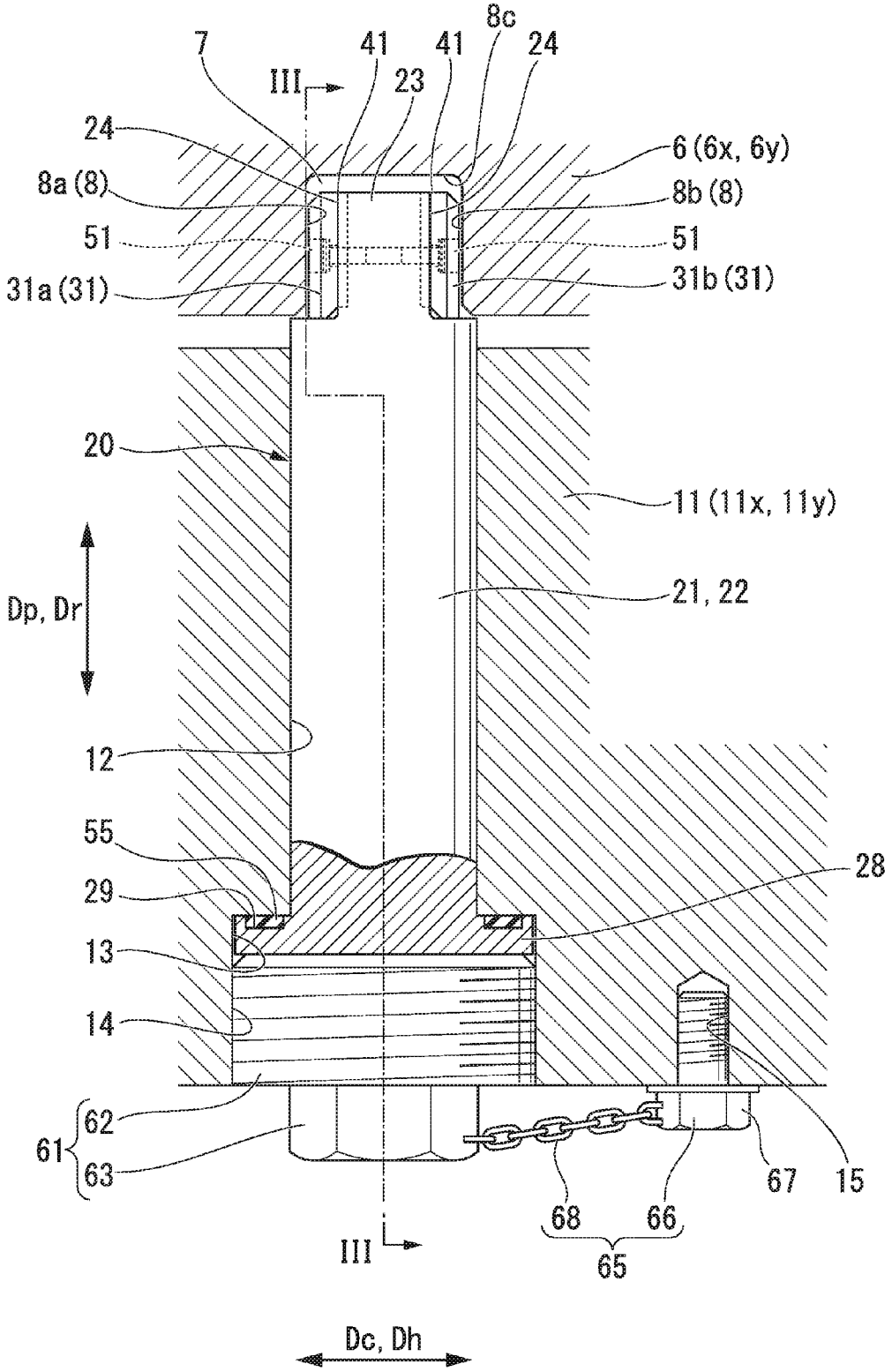
FIG. 2 is a side view of a positioning device according to an embodiment of the present invention.
Figure 3:
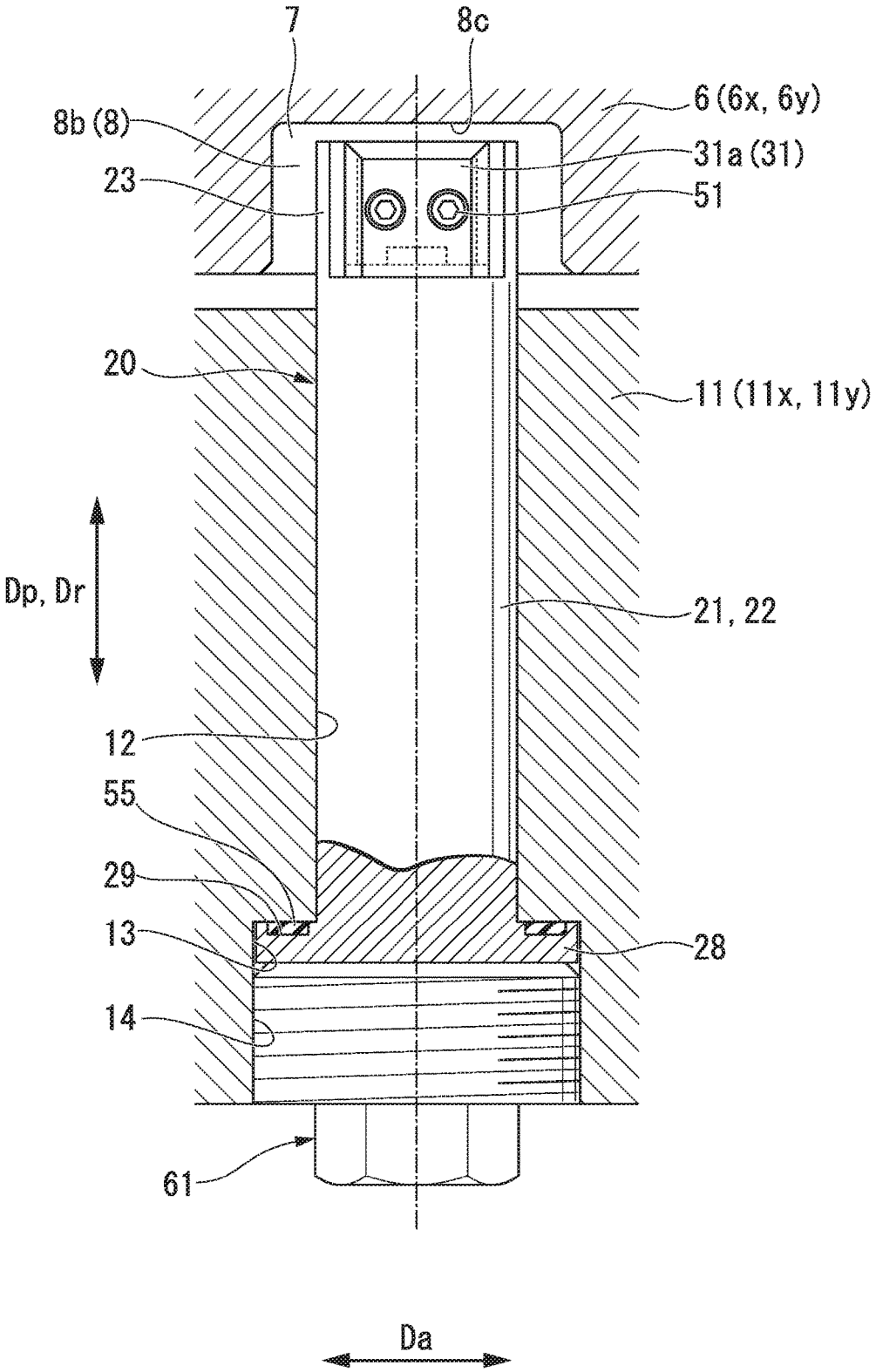
FIG. 3 is a cross-sectional view taken along line in FIG. 2.
Figure 4:
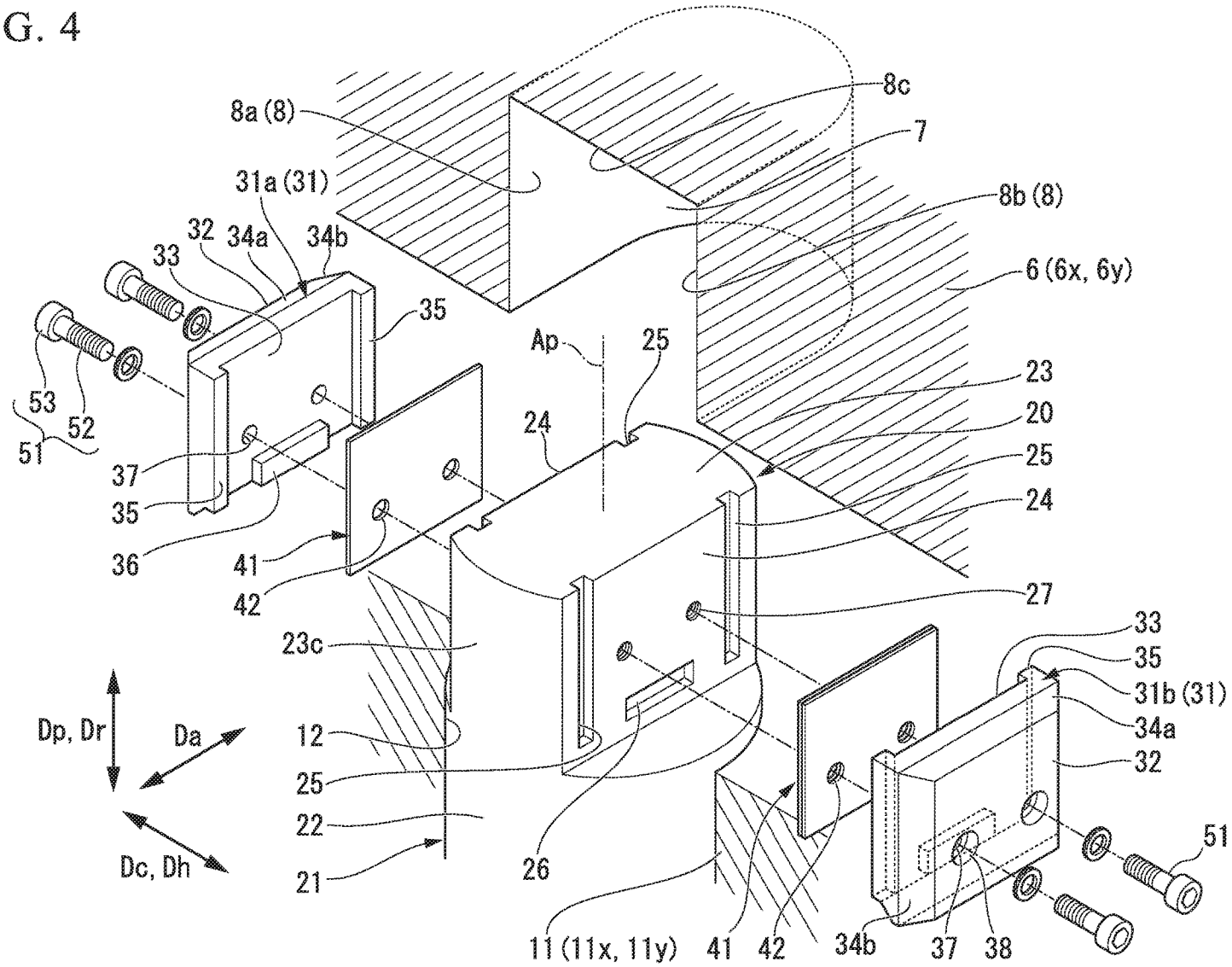
FIG. 4 is an exploded perspective view of the major part of the positioning device according to the embodiment of the present invention.

As shown in FIGS. 2 to 4, a cylindrical pin insertion hole 12 that penetrates the half casing from the outer circumferential side to the inner circumferential side and a flange receiving recess 13 that is concave from the outer circumferential side to the inner circumferential side and that communicates with the pin insertion hole 12 are formed in the half casing 11. The inner diameter of the flange receiving recess 13 is larger than the inner diameter of the pin insertion hole 12. A female thread 14 is formed on the inner circumferential surface of the flange receiving recess 13. The pin insertion hole 12 penetrates the half casing 11 from the bottom surface of the flange receiving recess 13 to the inner circumferential side thereof.

In the half blade ring 6, a pin groove 7 that is concave from the outer circumferential side to the inner circumferential side is formed at a position which faces the pin insertion hole 12 of the half casing 11 in the radial direction Dr. As shown in FIGS. 2 and 4, the pin groove 7 is defined by a groove bottom surface 8*c* that is formed in the half blade ring 6 and a pair of groove side surfaces 8 that are formed in the half blade ring 6 and that face each other in the horizontal direction Dh.

As shown in FIG. 1, the pin insertion hole 12 and the flange receiving recess 13 of the half casing 11 and the pin groove 7 of the half blade ring 6 are all formed on a vertical line Lv that intersects the axis Ar and extends in the vertical direction.

As shown in FIGS. 2 to 4, the positioning device 20 includes a pin 21 that is inserted into the pin insertion hole 12 of the half casing 11 and the pin groove 7 of the half blade ring 6, liner holders 31 that come in contact with the groove side surfaces 8 of the pin groove 7, liners 41 that are each disposed between the liner holder 31 and the pin 21 in the pin groove 7, fixing screws (liner fittings) 51 that fix the liner 41 and the liner holder 31 to the pin 21, a seal member 55 that seals a space between the pin 21 and the half casing 11, a pin holding screw 61 that comes in contact with the head of the pin 21, and a locking tool 65 that regulates looseness of the pin holding screw 61. The liner holders 31 include a first liner holder 31*a* that comes in contact with a first groove side surface 8*a* out of the pair of groove side surfaces 8 of the pin groove 7 and a second liner holder 31*b* that comes in contact with a second groove side surface 8*b*.

Figure 5:
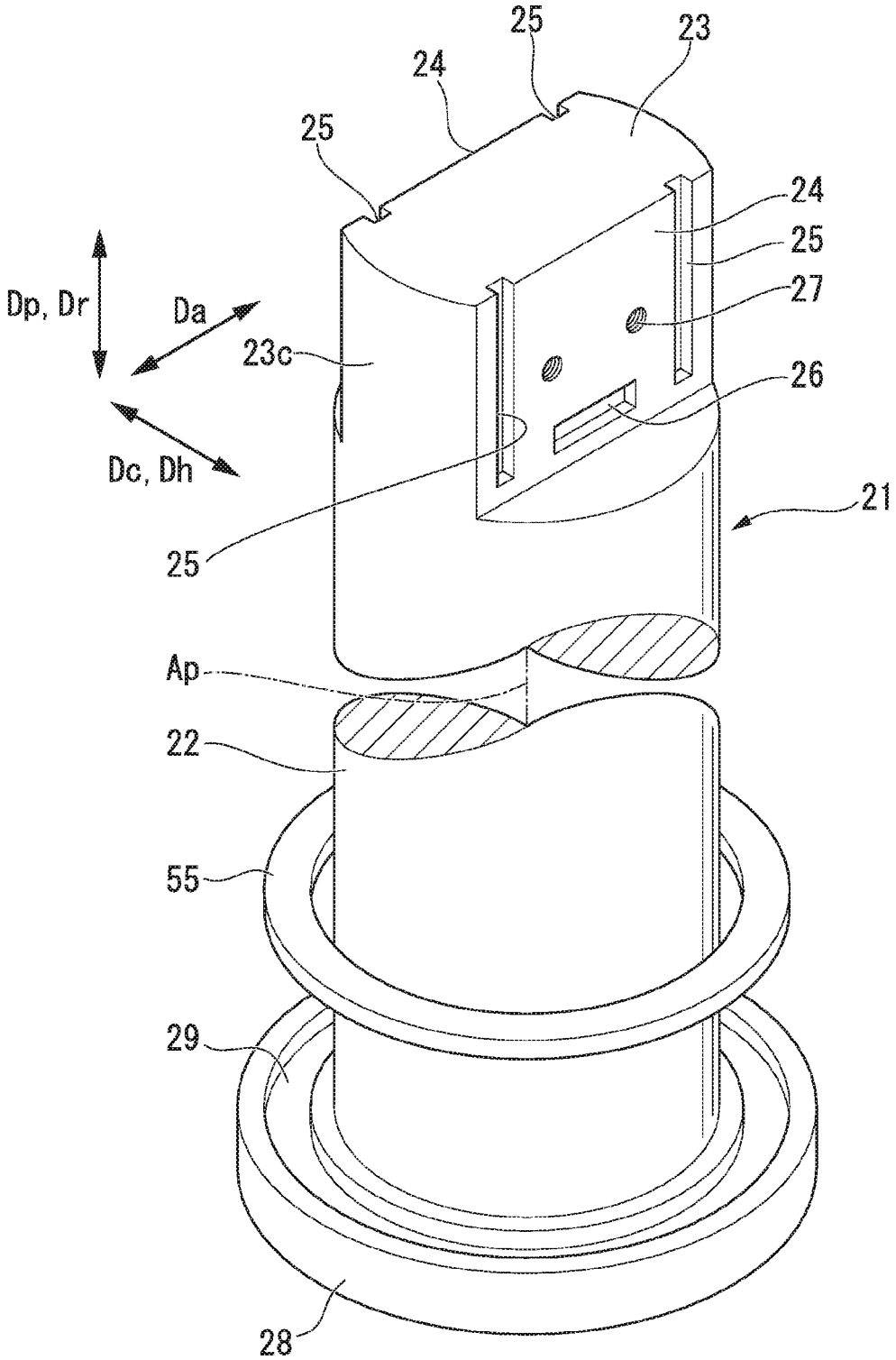
FIG. 5 is a perspective view of a pin according to the embodiment of the present invention.
Figure 6:
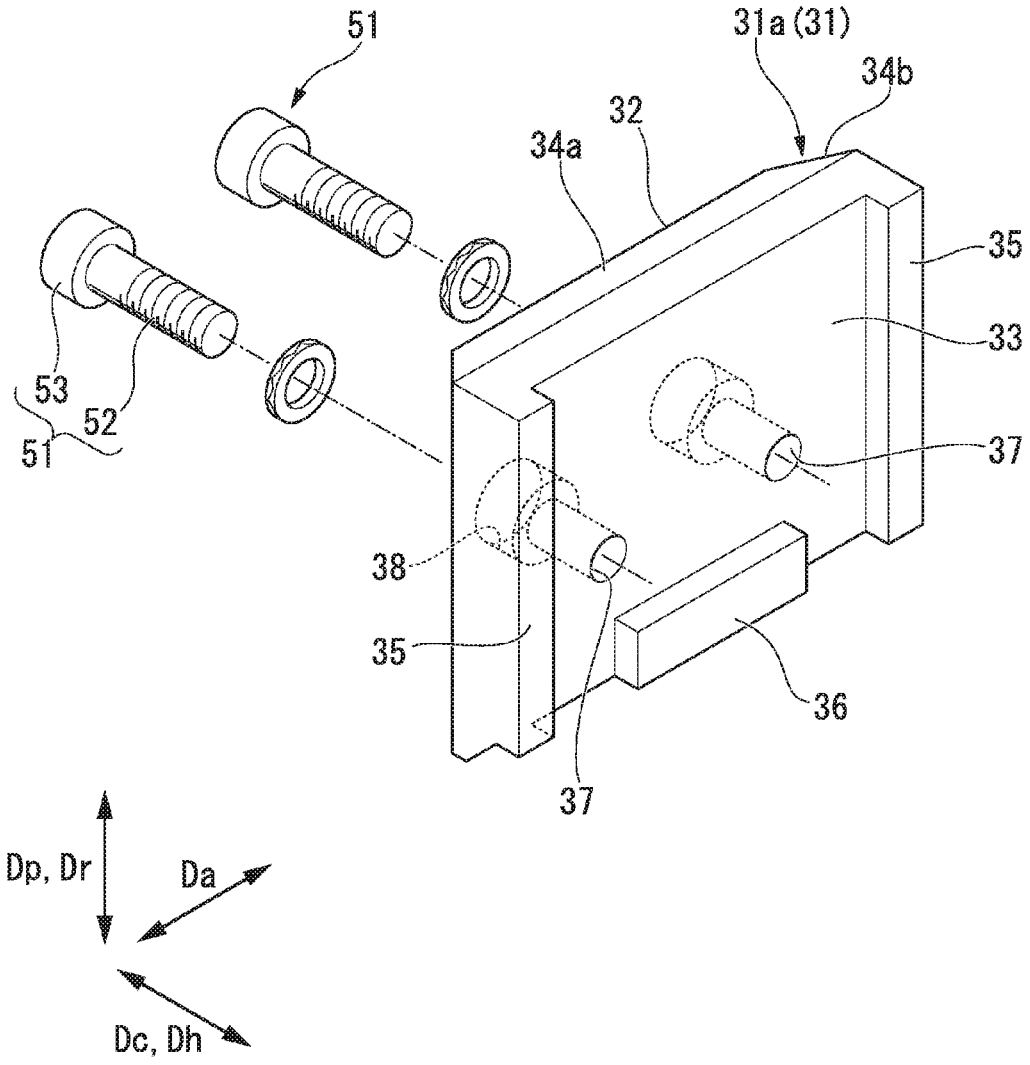
FIG. 6 is a perspective view of a liner holder according to the embodiment of the present invention.
Figure 7:
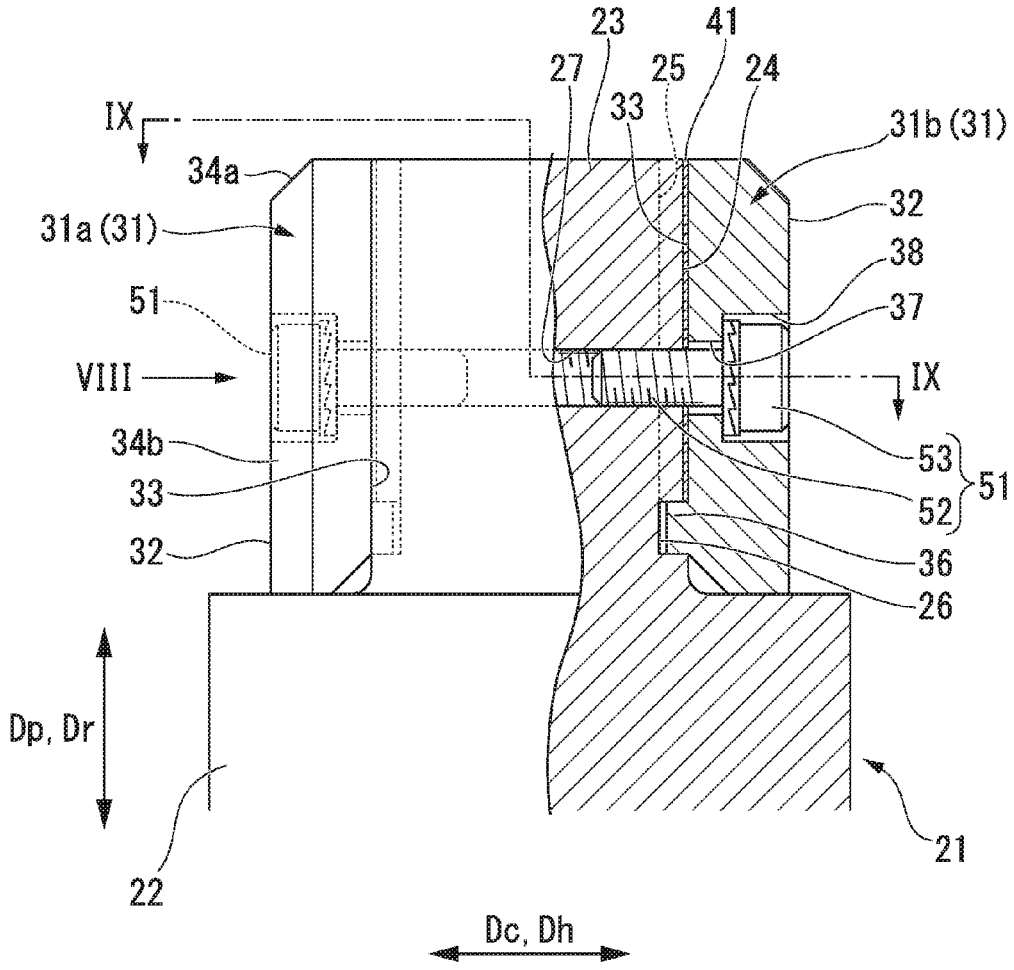
FIG. 7 is a cutaway side view of the major part of the positioning device according to the embodiment of the present invention.
Figure 8:
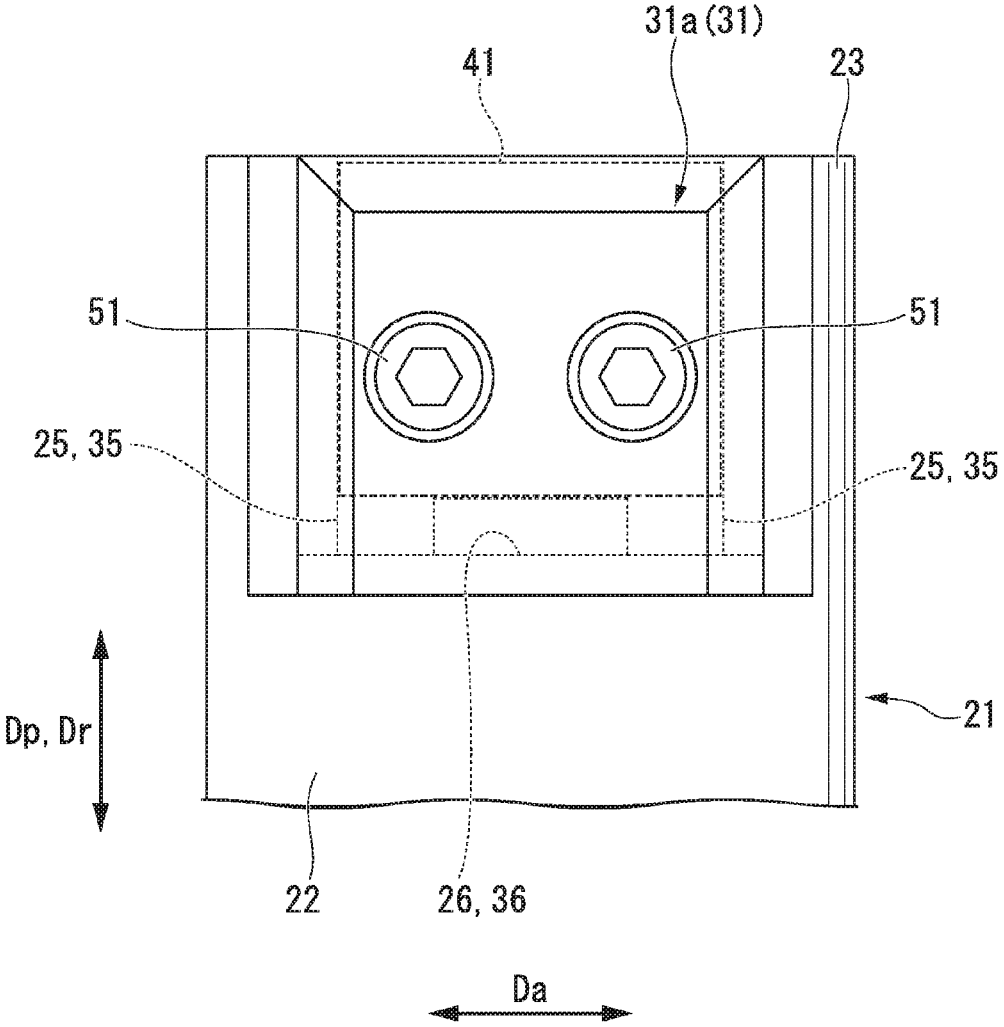
FIG. 8 is a view taken in the direction of arrow VIII in FIG. 7.
Figure 9:
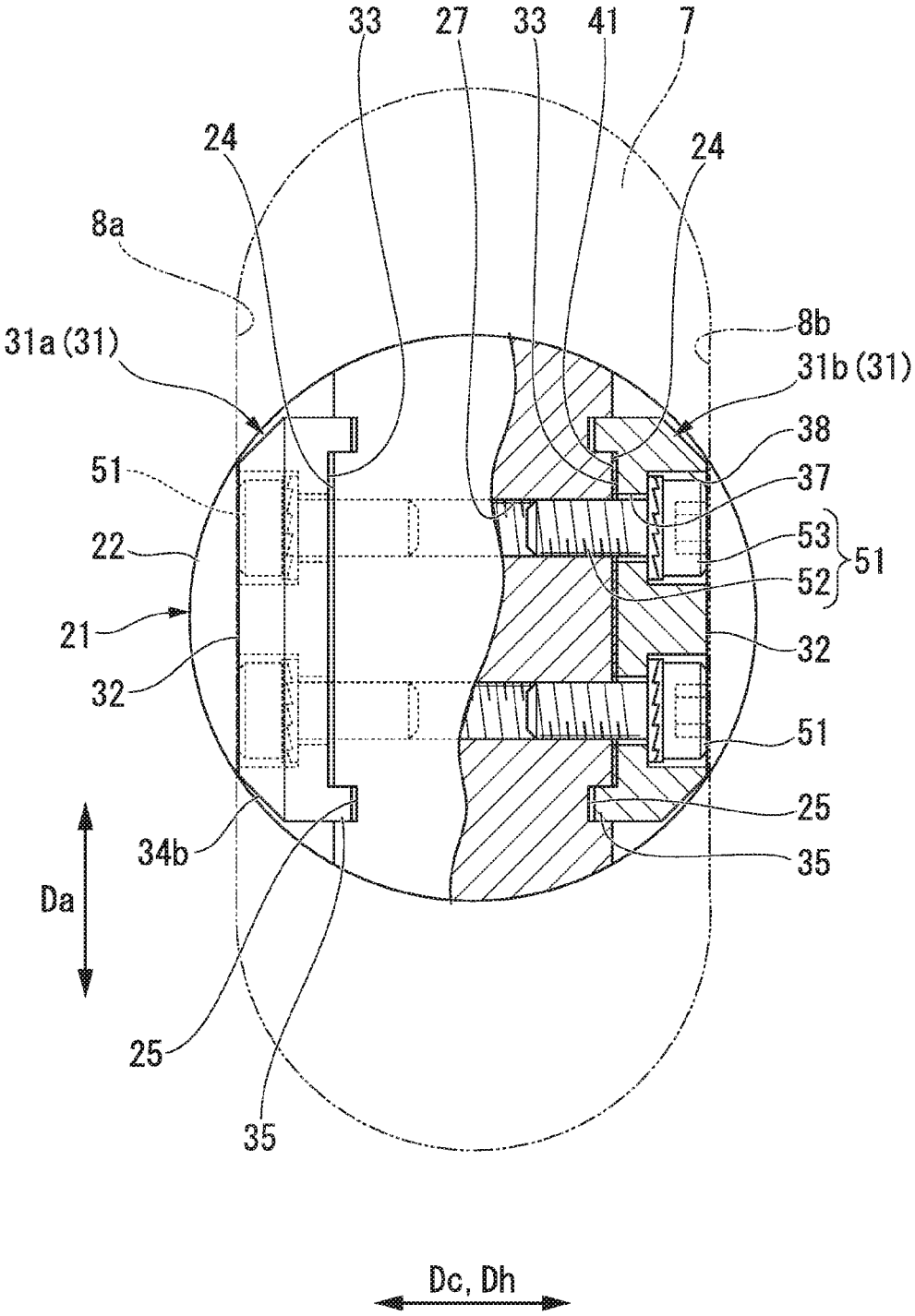
FIG. 9 is a cross-sectional view taken along line IX-IX in FIG. 7.

As shown in FIGS. 2, 4, and 5, the pin 21 includes a cylindrical insertion portion 22 that is inserted into the pin insertion hole 12 of the half casing 11, a groove insertion portion 23 that is formed at one end of both ends of the insertion portion 22, and a head flange 28 that is formed at the other end of the insertion portion 22.

The diameter of the cylindrical insertion portion 22 is substantially equal to the inner diameter of the pin insertion hole 12 of the half casing 11.

A side circumferential surface 23*c* that extends from a part of the outer circumferential surface of the cylindrical insertion portion 22 and a pair of liner contact surfaces 24 that are located inside a virtual outer circumferential surface extending from the outer circumferential surface of the insertion portion 22 are formed in the groove insertion portion 23. The virtual outer circumferential surface is a virtual surface extending from the outer circumferential surface of the insertion portion 22 in an insertion direction Dp in which a pin axis Ap (see FIGS. 4 and 5) as a central axis of the cylindrical insertion portion 22 extends. The liner contact surfaces 24 are both located inside the virtual outer circumferential surface and face the opposite sides in the direction perpendicular to the pin axis Ap. A groove insertion portion thickness Wd which is a gap dimension between the pair of liner contact surfaces 24 is smaller than the diameter of the cylindrical insertion portion 22. A pair of first engaging recesses (engaging portions, first engaging portions) 25 and a second engaging recess (engaging portion, second engaging portion) 26, which are concave toward the other liner contact surface 24, are formed on each of the pair of liner contact surfaces 24. The first engaging recess 25 is formed long in the insertion direction Dp in which the pin axis Ap extends. The first engaging recesses 25 are formed on the liner contact surface 24 with a gap therebetween in the direction which is perpendicular to the insertion direction Dp and along the liner contact surface 24. The second engaging recess 26 is formed long in the direction which is perpendicular to the insertion direction Dp and along the liner contact surface 24. The second engaging recess 26 is formed at a position in the vicinity of the insertion portion 22 of the liner contact surface 24. Screw holes 27 into which the fixing screws 51 are screwed are formed between the pair of first engaging recesses 25 of the groove insertion portion 23.

The head flange 28 has a disk shape centered on the pin axis Ap. The diameter of the head flange 28 is larger than the diameter of the cylindrical insertion portion 22 and the inner diameter of the pin insertion hole 12 of the half casing 11 and is smaller than the inner diameter of the flange receiving recess 13 of the half casing 11. In the head flange 28, an annular seal groove 29 centered on the pin axis Ap is formed on the surface on which the insertion portion 22 is formed. The seal member 55 has a ring shape and a part of the seal member 55 is inserted into the seal groove 29.

As shown in FIG. 2, the pin holding screw 61 includes a threaded portion 62 in which a male thread to be screwed into the female thread 14 formed in the flange receiving recess 13 of the half casing 11 is formed and a screw head 63 that is formed at an end of the threaded portion 62. The screw head 63 has a hexagonal pillar shape so as to engage with a tool such as a wrench.

The locking tool 65 includes a locking screw 66 that can be screwed into a locking screw hole 15 adjacent to the pin insertion hole 12 of the half casing 11 and a wire 68 that connects the screw head 63 of the pin holding screw 61 to the screw head 67 of the locking screw 66. The wire 68 may be directly connected to the screw head 63 of the pin holding screw 61 and the screw head 67 of the locking screw 66, but may be connected to the screw heads 63 and 67 via a pin fitted to the screw heads 63 and 67 of the screws 61 and 66.

The first liner holder 31*a* and the second liner holder 31*b* have the same shape. Therefore, only the first liner holder 31*a* will be described below. As shown in FIG. 4 and FIGS. 6 to 9, a groove contact surface 32 that comes in contact with the first groove side surface 8*a* of the pin groove 7, a liner contact surface 33 that faces the opposite side from the side which the groove contact surface 32 faces, a first tapered surface 34*a* that extends from the groove contact surface 32, and a pair of second tapered surfaces 34*b* that extend from the groove contact surface 32 are formed in the first liner holder 31*a*. The first tapered surface 34*a* is inclined relative to the groove contact surface 32 so as to gradually get closer to the liner contact surface 33 as it gets closer to a pin insertion side from the groove contact surface 32 in a state in which the first liner holder 31*a* is fixed to the groove insertion portion 23 of the pin 21. The pin insertion side is one side in the insertion direction Dp in which the pin axis Ap (see FIGS. 4 and 5) extends and is the opposite side from the insertion portion 22 of the pin 21 with respect to the groove insertion portion 23 of the pin 21. The pair of second tapered surfaces 34*b* are disposed on the opposite sides of the first liner holder 31*a* in a liner holder width direction which is perpendicular to the insertion direction Dp and along the groove contact surface 32 in a state in which the first liner holder 31*a* is fixed to the groove insertion portion 23 of the pin 21. The pair of second tapered surfaces 34*b* are inclined relative to the groove contact surface 32 so as to be gradually spaced away from the opposite second tapered surface 34*b* as they get closer from the groove contact surface 32 to the liner contact surface 33. First engaged convex portions 35 which are fitted into the first engaging recesses 25 of the pin 21 and a second engaged convex portion 36 which is fitted into the second engaging recess 26 of the pin 21 are formed on the liner contact surface 33. The first engaged convex portions 35 are formed as a pair with a gap therebetween similarly to the pair of first engaging recesses 25 of the pin 21. Screw insertion portions 37 which pass from the groove contact surface 32 to the liner contact surface 33 and into which the threaded portions 52 of the fixing screws 51 are inserted and screw head receiving recesses 38 which communicate with the screw insertion portions 37 and into which screw heads 53 of the fixing screws 51 are received are formed between the pair of first engaged convex portions 35 of the first liner holder 31*a*. The screw head receiving recess 38 is concave from the groove contact surface 32 toward the liner contact surface 33. The groove contact surface 32 of the second liner holder 31*b* comes in contact with the second groove side surface 8*b* of the pin groove 7.

Figure 10:
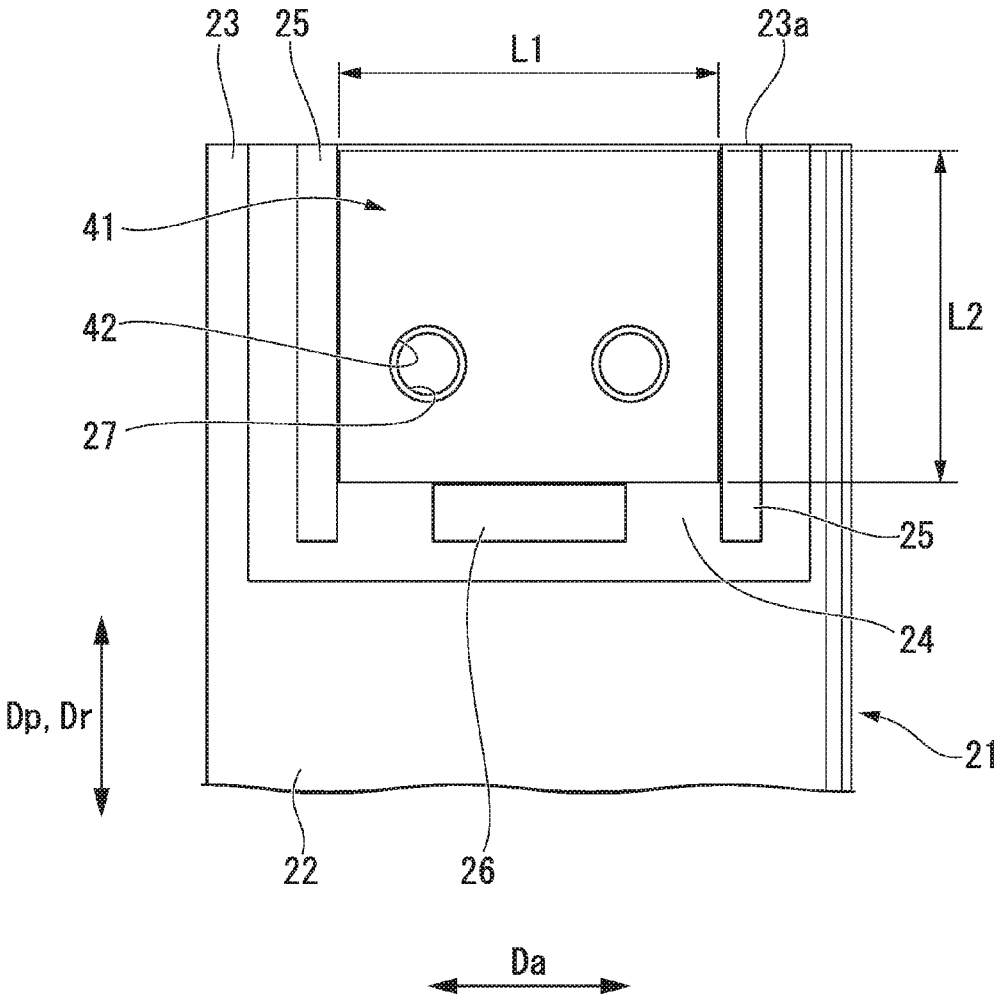
FIG. 10 is a side view of the major part of the positioning device according to the embodiment of the present invention in which the liner holder is omitted.

As shown in FIGS. 4 and 10, the liner 41 has a rectangular plate shape or sheet shape. Screw insertion portions 42 into which the threaded portions 52 of the fixing screws 51 are inserted are formed in the liner 41. A length L1 (see FIG. 10) of a pair of sides facing each other in the insertion direction Dp of the liner 41 is slightly smaller than the gap dimension between the pair of first engaging recesses 25 of the pin 21 and the gap dimension between the pair of first engaged convex portions 35 of the first liner holder 31*a*. A length L2 of the other pair of sides facing each other in the liner 41 is slightly smaller than the length from an edge of the second engaging recess 26 of the pin 21 to a tip 23*a* of the groove insertion portion 23 in the insertion direction Dp. Accordingly, when the liner 41 is brought into contact with the liner contact surface 24 of the pin 21 and the positions of the screw holes 27 of the pin 21 are matched with the screw insertion portions 42 of the liner 41, the liner 41 is received in the space between the pair of first engaging recesses 25 of the pin 21 and is received in the space from the edge of the second engaging recess 26 of the pin 21 to the tip 23*a* of the groove insertion portion 23.

That is, when the liner 41 is disposed between the groove insertion portion 23 of the pin 21 and the liner holder 31, the liner 41 can be disposed at a position other than the positions of the engaging portions 25 and 26 of the groove insertion portion 23 and the engaged portions 35 and 36 of the liner holder 31. Accordingly, in this embodiment, the liner 41 is not likely to stick to the pin 21 and the liner 41 can be easily detached from the pin 21 when the positioning device 20 is detached.

Figure 15:
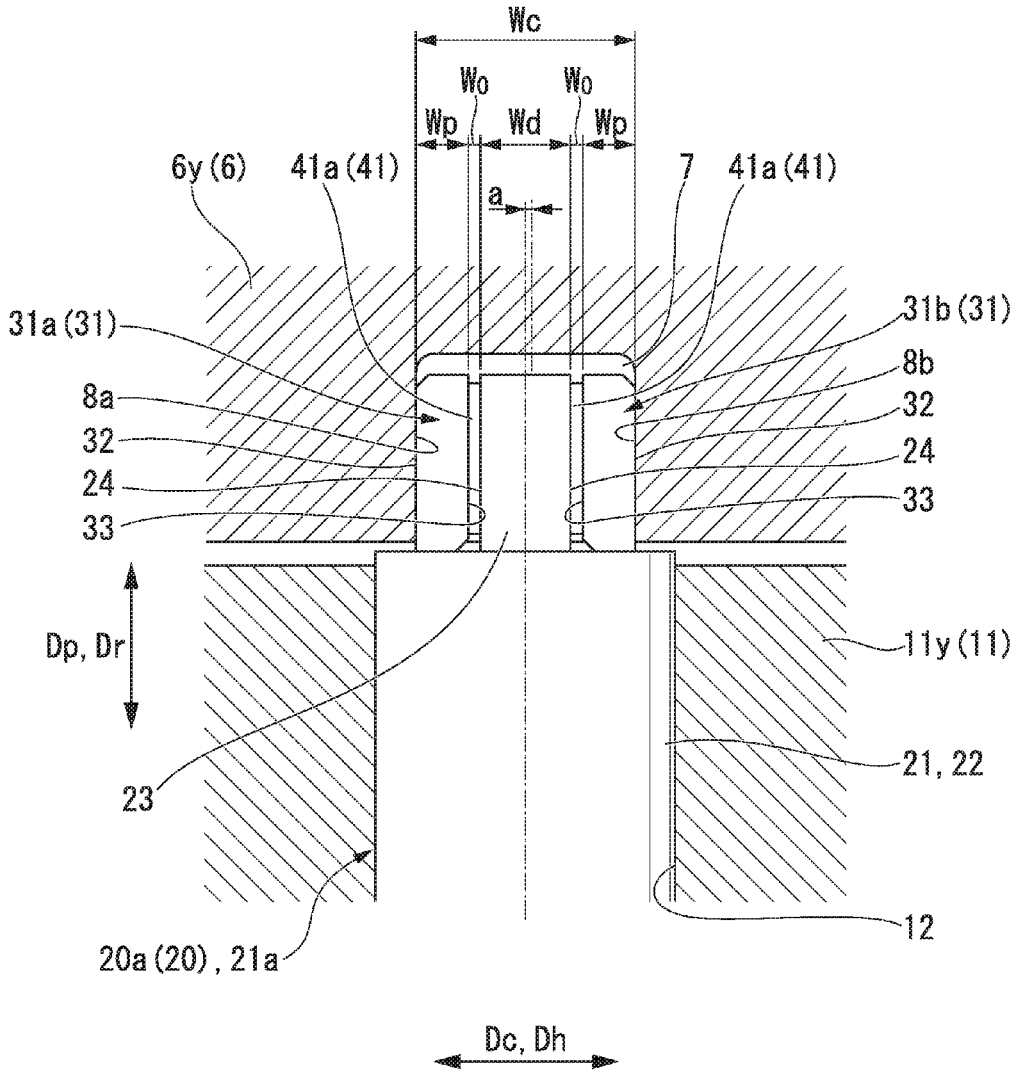
FIG. 15 is a side view of the major part of a temporary positioning device according to an embodiment of the present invention.
Figure 16:
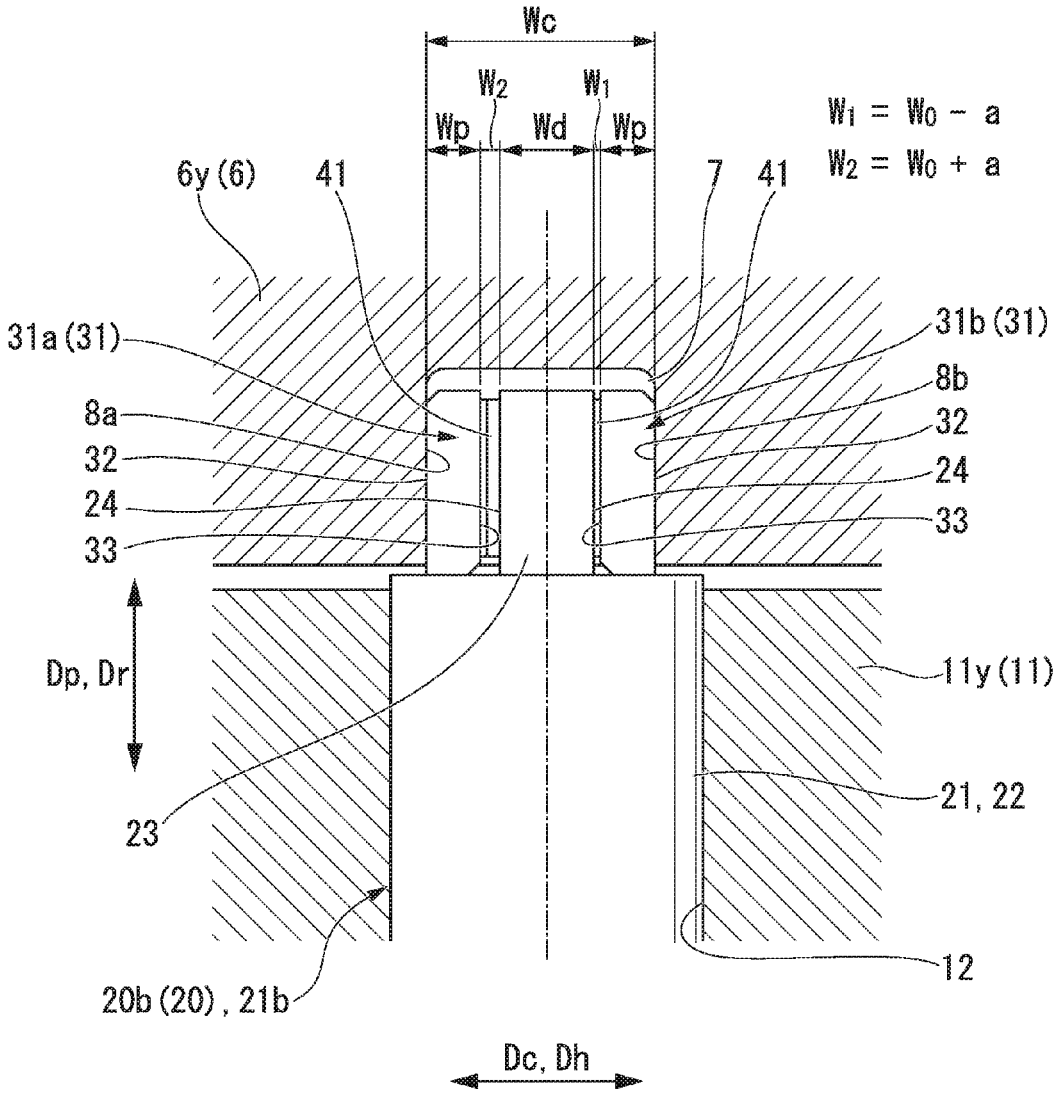
FIG. 16 is a side view of the major part of an adjusted positioning device according to an embodiment of the present invention.

As shown in FIGS. 15 and 16, a groove width We which is the gap dimension between the first groove side surface 8*a* and the second groove side surface 8*b* of the pin groove 7 is larger than the total dimension of a liner holder thickness Wp which is the gap dimension between the groove contact surface 32 and the liner contact surface 33 of the first liner holder 31*a*, a liner holder thickness Wp which is the gap dimension between the groove contact surface 32 and the liner contact surface 33 of the second liner holder 31*b*, and the groove insertion portion thickness Wd of the groove insertion portion 23. A plurality of types of liners 41 having different thicknesses are present as the liner 41. For example, there are a plurality of each of the liners 41 with thicknesses of 0.05 mm, 0.1 mm, 0.2 mm, and 0.3 mm.

Figure 11:
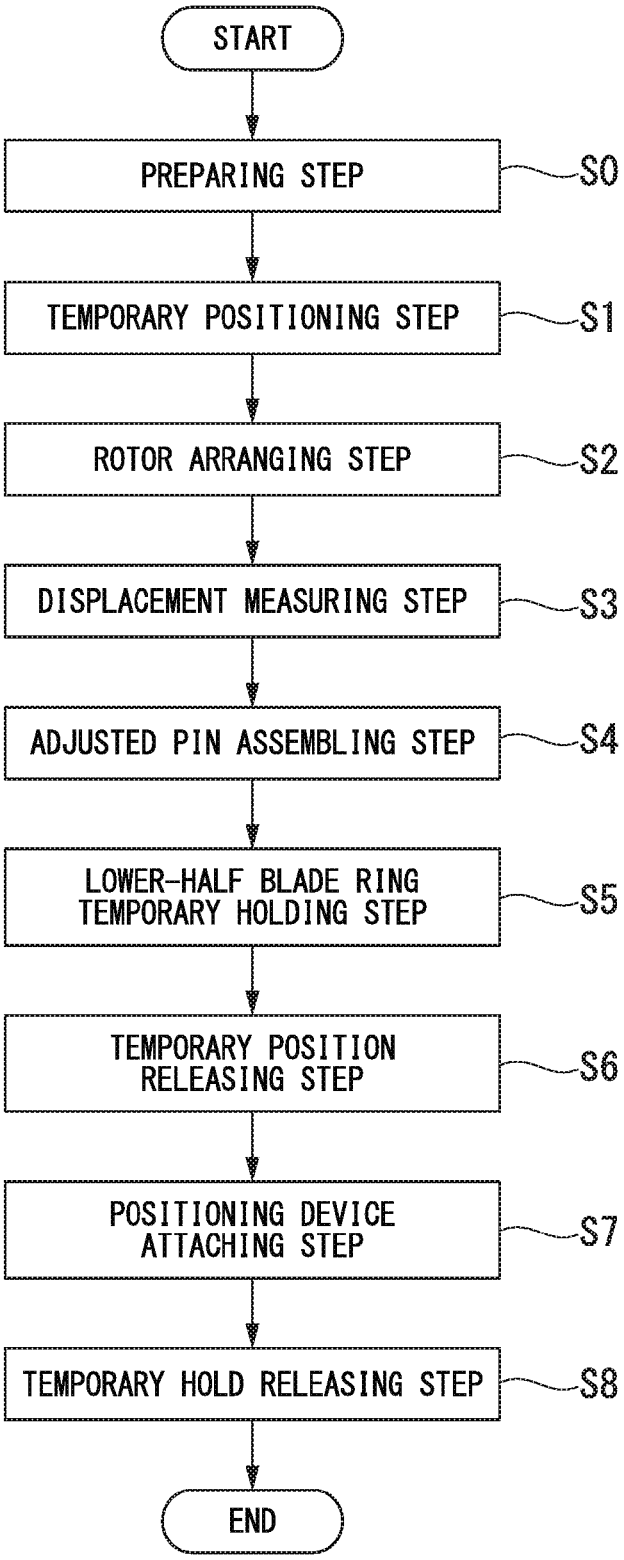
FIG. 11 is a flowchart showing a flow of a positioning method according to an embodiment of the present invention.

A positioning method of the half blade ring 6 using the above-described positioning device 20 will be described below with reference to the flowchart shown in FIG. 11. This positioning is performed when a steam turbine is newly installed, when the blade ring 5 as a component of the steam turbine is retrofitted, or the like. The method of positioning the lower-half blade ring 6*y* relative to the lower-half casing 11*y* using the positioning device 20 will be described below.

First, the above-described positioning device 20 is prepared (S0: preparing step). That is, the pin 21, the liner 41, the liner holder 31, the fixing screw (liner fitting) 51, the seal member 55, the pin holding screw 61, and the locking tool 65 which constitute the positioning device 20 are prepared. At this time, a plurality of liners 41 having different thicknesses are prepared.

Before the positioning work is actually started, the lower-half blade ring 6*y* is separated from the lower-half casing 11*y*. The rotor 1 is not supported by a bearing unit (not shown) which is disposed in the lower-half casing 11*y*.

Figure 12:
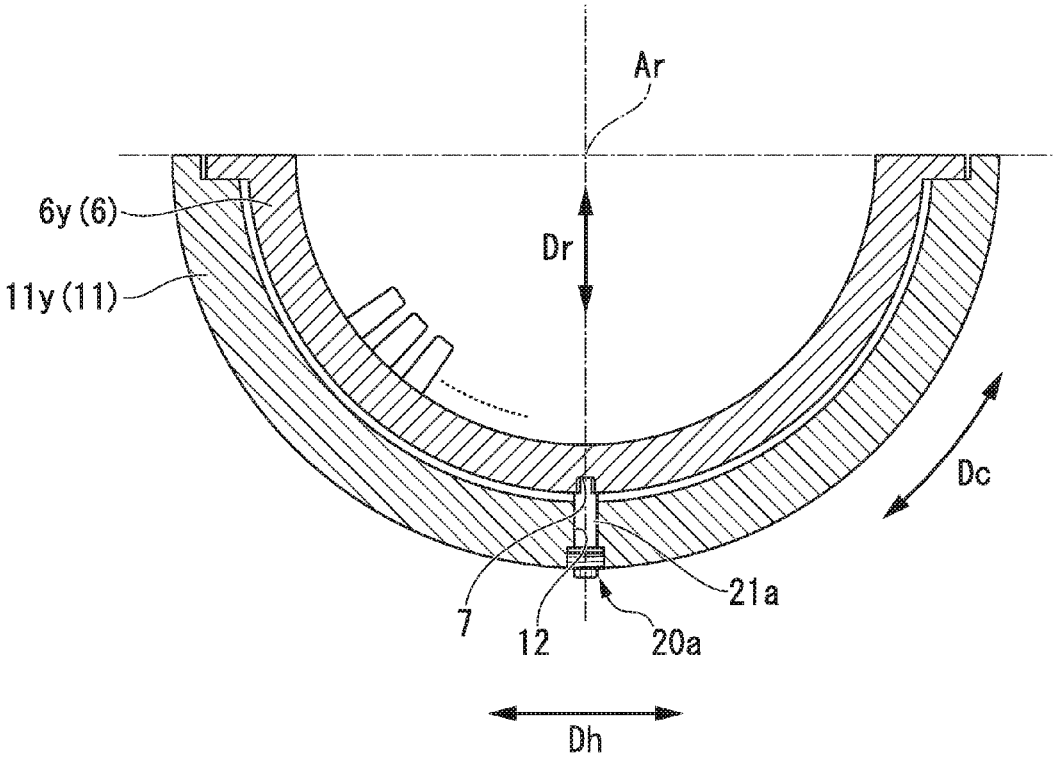
FIG. 12 is a (first) diagram showing the positioning method according to the embodiment of the present invention.

When the positioning work is actually started, first, the lower-half blade ring 6*y* is hung by a crane or the like and the lower-half blade ring 6*y* is put into the lower-half casing 11*y*. In the course of this process, as shown in FIG. 12, the lower-half blade ring 6*y* is temporarily positioned relative to the lower-half casing 11*y* in the horizontal direction Dh using a temporary positioning device 20*a* including a temporary pin 21*a* (51: temporary positioning step).

As shown in FIG. 15, the temporary pin 21*a* of the temporary positioning device 20*a* includes the same pin 21 as in the positioning device 20 according to this embodiment, a pair of liner holders 31, and a pair of regular liners 41*a* with a regular thickness. In this case, the regular thickness of the pair of regular liners 41*a* is set such that the total dimension of the thickness Wo of the pair of regular liners 41*a*, the liner holder thickness Wp of the pair of liner holders 31, and the groove insertion portion thickness Wd of the groove insertion portion 23 of the pin 21 is substantially equal to the groove width Wc of the pin groove 7. The temporary pin 21*a* includes a cylindrical insertion portion 22 which is inserted into the pin insertion hole 12 of the half casing 11 and a groove insertion portion that is formed at an end of the insertion portion 22, and the thickness of the groove insertion portion may be substantially equal to the groove width Wc of the pin groove 7. That is, the temporary pin 21*a* used here is not particularly limited as long as the thickness of a part inserted into the pin groove 7 is substantially equal to the groove width Wc of the pin groove 7. It is preferable that the temporary positioning device 20*a* be prepared in the preparing step (S0).

Figure 13:
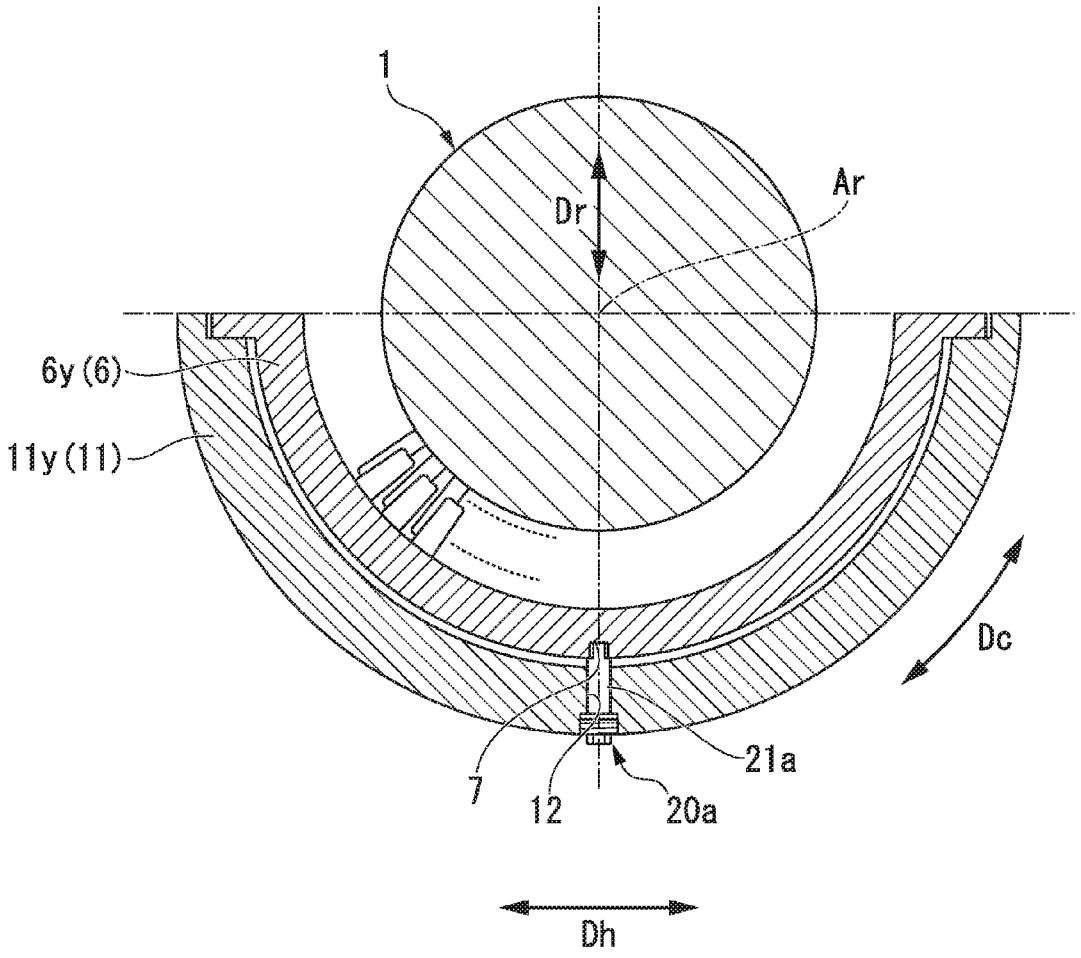
FIG. 13 is a (second) diagram showing the positioning method according to the embodiment of the present invention.

Then, as shown in FIG. 13, the rotor 1 is arranged in the lower-half casing 11*y* using a crane or the like (S2: rotor arranging step). In the course of this process, the rotor 1 is supported by the bearing unit (not shown) disposed in the lower-half casing 11*y* and the position of the rotor 1 relative to the lower-half casing 11*y* in the horizontal direction Dh is determined.

Then, a displacement of the lower-half blade ring 6*y* relative to the rotor 1 or the lower-half casing 11*y* in the horizontal direction Dh is measured (S3: displacement measuring step). Since the position of the rotor 1 relative to the lower-half casing 11*y* in the horizontal direction Dh is determined already, the displacement of the lower-half blade ring 6*y* relative to the rotor 1 in the horizontal direction Dh is equal to the displacement of the lower-half blade ring 6*y* relative to the lower-half casing 11*y* in the horizontal direction Dh.

Then, the liner 41 having the thickness corresponding to the displacement measured in the displacement measuring step (S3) is selected and the selected liner 41 is attached to the pin 21 (S4: adjusted pin assembling step). Specifically, for example, as shown in FIG. 15, the displacement of the lower-half blade ring 6*y*, which has been temporarily positioned with the temporary pin 21*a*, relative to the lower-half casing 11*y* in the horizontal direction Dh is defined as a. At this time, the thicknesses of the pair of regular liners 41*a* which are components of the temporary pin 21*a* are both defined as Wo. In order to correct the displacement a, as shown in FIG. 16, the thickness W1 of one liner 41 out of the pair of liners 41 is (Wo-a) and the thickness W2 of the other liner 41 is (Wo+a). Therefore, the liner 41 having the thickness W1 (Wo-a) and the liner 41 having the thickness W2 (Wo+a) are selected among the plurality of liners 41 prepared in the preparing step (S0). The liners 41 are attached to the groove insertion portion 23 of the pin 21 using the liner holders 31 and the fixing screws 51. The pin 21 to which the selected liners 41 are attached constitutes an adjusted pin 21*b*. The liner 41 having the thickness W1 (Wo-a) and the liner 41 having the thickness W2 (Wo+a) do not have to be single liners 41 but may be constituted by a plurality of liners 41.

In a state in which the liners 41 and the liner holders 31 are fixed to the groove insertion portion 23 of the pin 21, the liner holders 31 are located inside the virtual outer circumferential surface extending from the outer circumferential surface of the cylindrical insertion portion 22.

Then, the lower-half blade ring 6*y* which has been temporarily positioned is temporarily held with a crane or the like so as to be movable in the horizontal direction Dh (S5: temporary holding step).

Figure 14:
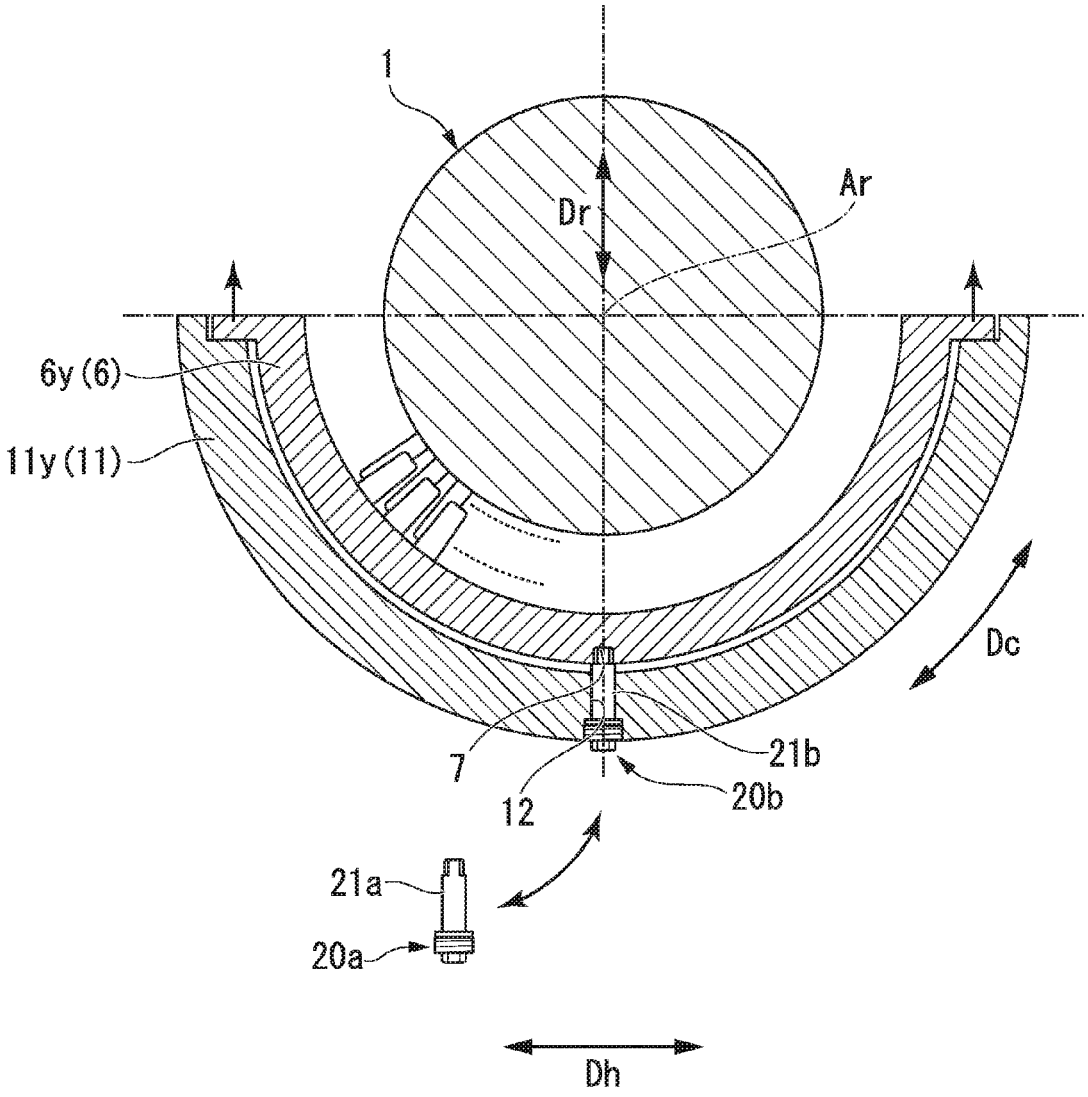
FIG. 14 is a (third) diagram showing the positioning method according to the embodiment of the present invention.

Then, as shown in FIG. 14, the temporary positioning device 20*a* temporarily positioning the lower-half blade ring 6*y* is detached from the lower-half blade ring 6*y* and the lower-half casing 11*y* (S6: temporary position releasing step). The above-described temporary holding step (S5) may be performed after the temporary position releasing step (S6) is performed.

Subsequently, as shown in FIG. 14, an adjusted positioning device 20*b* instead of the temporary positioning device 20*a* is attached to the lower-half blade ring 6*y* and the lower-half casing 11*y* (S7: positioning device attaching step). The adjusted positioning device 20*b* is a positioning device 20 including the above-described adjusted pin 21*b*. In attaching the adjusted positioning device 20*b*, the adjusted pin 21*b* is first put into the pin insertion hole 12 of the lower-half casing 11*y* and the pin groove 7 of the lower-half blade ring 6*y*. At this time, the seal member 55 is put in advance into the seal groove 29 of the pin 21.

As described above, the side circumferential surface 23*c* extending from a part of the outer circumferential surface of the cylindrical insertion portion 22 is formed in the groove insertion portion 23 of the pin 21. In a state in which the liners 41 and the liner holders 31 are fixed to the groove insertion portion 23 of the pin 21, the liner holders 31 are located inside the above-described virtual outer circumferential surface extending from the outer circumferential surface of the cylindrical insertion portion 22. In the liner 41, the tapered surface 34 is formed on the pin insertion side thereof. Accordingly, the adjusted pin 21*b* can be easily inserted into the pin insertion hole 12 of the lower-half casing 11*y* and the pin groove 7 of the lower-half blade ring 6*y*.

Then, the pin holding screw 61 is screwed into the flange receiving recess 13 communicating with the pin insertion hole 12 of the lower-half casing 11*y*. When the pin holding screw 61 is screwed, the tip of the pin holding screw 61 comes in contact with the head flange 28 of the adjusted pin 21*b*. That is, the adjusted pin 21*b* is prevented from being pulled out from the pin insertion hole 12 by the pin holding screw 61. Then, as shown in FIG. 2, the locking tool 65 is attached to the pin holding screw 61. In attachment of the locking tool 65, the locking screw 66 is screwed into the locking screw hole 15 of the half casing 11. The screw head 67 of the locking screw 66 and the screw head 63 of the pin holding screw 61 are connected with the wire 68 to regulate rotation of the pin holding screw 61 in the loosening direction.

The temporary holding of the lower-half casing 11*y* using the crane or the like is released (S8: temporary hold releasing step).

In this way, the positioning of the lower-half blade ring 6*y* relative to the lower-half casing 11*y* in the horizontal direction Dh is completed.

In the above description, after the displacement measuring step (S3) and before the temporary holding step (S5) of the lower-half blade ring 6*y*, the adjusted pin assembling step (S6) is performed. However, the adjusted pin assembling step (S6) may be performed at any time after the displacement measuring step (S3) and before the positioning device attaching step (S7). In the above description, the locking tool 65 is attached immediately after the adjusted pin 21*b* and the pin holding screw 61 are attached. However, the attachment of the locking tool 65 may be performed after the basic assembly of the steam turbine is completed.

The method of positioning the lower-half blade ring 6*y* relative to the lower-half casing 11*y* has been described hitherto, but the method of positioning the upper-half blade ring 6*x* relative to the upper-half casing 11*x* basically has the same order as the above-described positioning method. In this case, however, the rotor arranging step (S2) is not performed. Specifically, first, the upper-half casing 11*x* is temporarily fixed such that the inner surface thereof faces the upside, and the upper-half blade ring 6*x* is temporarily positioned relative to the upper-half casing 11*x* using the temporary positioning device 20*a* (S1: temporary positioning step). Then, the displacement of the upper-half blade ring 6*x* relative to the upper-half casing 11*x* in the horizontal direction Dh is measured (S3: displacement measuring step). Subsequently, in the same way as in the method of positioning the lower-half blade ring 6*y* relative to the lower-half casing 11*y*, the adjusted pin assembly step (S4) and the like are performed. Thereafter, the adjusted positioning device 20*b* is detached and the upper-half blade ring 6*x* is detached from the upper-half casing 11*x*. Then, the upper-half blade ring 6*x*, the upper-half casing 11*x*, and the adjusted positioning device 20*b* are assembled into the lower-half blade ring 6*y* and the lower-half casing 11*y*.

As described above, since the positioning device 20 according to this embodiment includes the liner holders 31, it is not necessary to form the bolt receiving recess like the liner described in Patent Literature 1 in the liners 41. Accordingly, it is possible to easily manufacture the liners 41 and to suppress the manufacturing cost of the positioning device 20 even when a plurality of liners 41 are prepared in advance. Since the liner 41 is inserted between the liner holder 31 and the groove insertion portion 23 of the pin 21, it is possible to prevent contact of the liner 41 with steam and to suppress corrosion of the liner 41.

In this embodiment, since the first engaging recesses 25 and the second engaging recess 26 are formed in the groove insertion portion 23 of the pin 21 and the first engaged convex portions 35 and the second engaged convex portion 36 are formed in the liner holder 31, the liner holder 31 can be easily and accurately attached to a predetermined position of the pin 21. In this embodiment, the pair of first engaging recesses 25 are formed in the groove insertion portion 23 of the pin 21 so as to be long in the insertion direction Dp in which the pin axis Ap extends with a gap therebetween, and the pair of first engaged convex portions 35 inserted into the engaging recesses are formed in the liner holder 31 so as to be long in the insertion direction Dp with a gap therebetween. The liner 41 is disposed between the pair of first engaging recesses 25 and the pair of first engaged convex portions 35. Accordingly, in this embodiment, it is possible to prevent the contact of the liner 41 with steam from both sides in the width direction thereof.

When it is intended to pull out the pin 21 from the pin groove 7 in a state in which the wall surface of the pin groove 7 and the liner holder 31 stick to each other, there is a possibility that an excessive load will be applied to the fixing screw 51 fixing the liner holder 31 to the pin 21, the fixing screw 51 will be destroyed, and the liner holder 31 will be left in the pin groove 7. In this embodiment, the second engaging recesses 26 and the second engaged convex portions 36 are both formed to be long in the direction perpendicular to the insertion direction Dp. Accordingly, when the pin 21 is moved in the insertion direction Dp, the liner holder 31 moves in the insertion direction Dp along with the pin 21. Accordingly, in this embodiment, when the pin 21 is detached from the pin groove 7 and the pin insertion hole 12, it is possible to reduce the possibility that the liner holder 31 will be left in the pin groove 7.

In this embodiment, since the seal member 55 is disposed between the head flange 28 of the pin 21 and the bottom surface of the flange receiving recess 13 of the half casing 11, it is possible to prevent steam in the casing 10 from leaking to the outside via the pin insertion hole 12 of the casing 10.

In this embodiment, since the pin holding screw 61 is screwed into the flange receiving recess 13 communicating with the pin insertion hole 12, it is possible to prevent the pin 21 from dropping from the pin insertion hole 12. In this embodiment, when the pin 21 inserted into the pin insertion hole 12 is detached, it is possible to simply detach the pin 21 by loosening the pin holding screw 61 and detaching the pin holding screw 61. In this embodiment, since the looseness of the pin holding screw 61 can be regulated using the locking tool 65, it is possible to prevent the pin 21 from dropping with the dropping of the pin holding screw 61. The head of the pin 21 or the threaded portion 62 of the pin holding screw 61 may be caulked in the half casing 11 using a punch or the like.

Modified Examples

Various modified examples of the above-described positioning device 20 will be described below.

Figure 17:
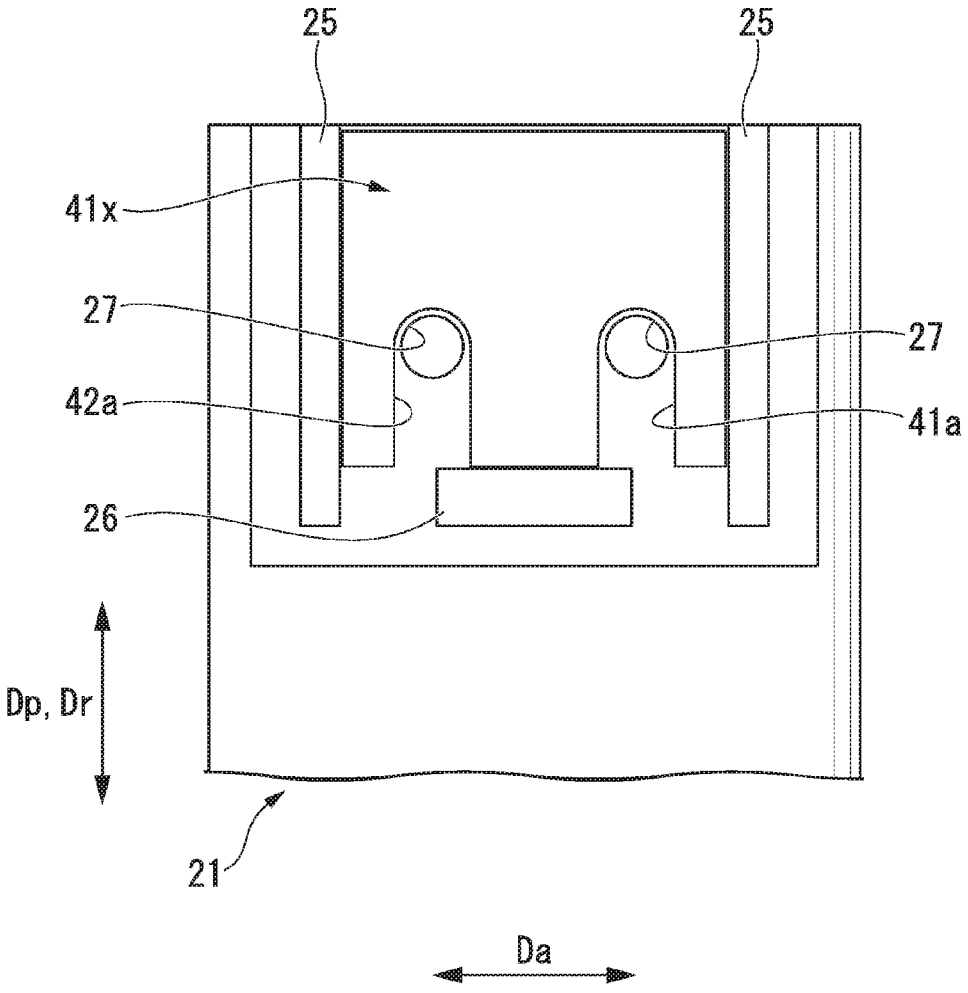
FIG. 17 is a front view of a liner according to a first modified example of the embodiment of the present invention.
Figure 18:
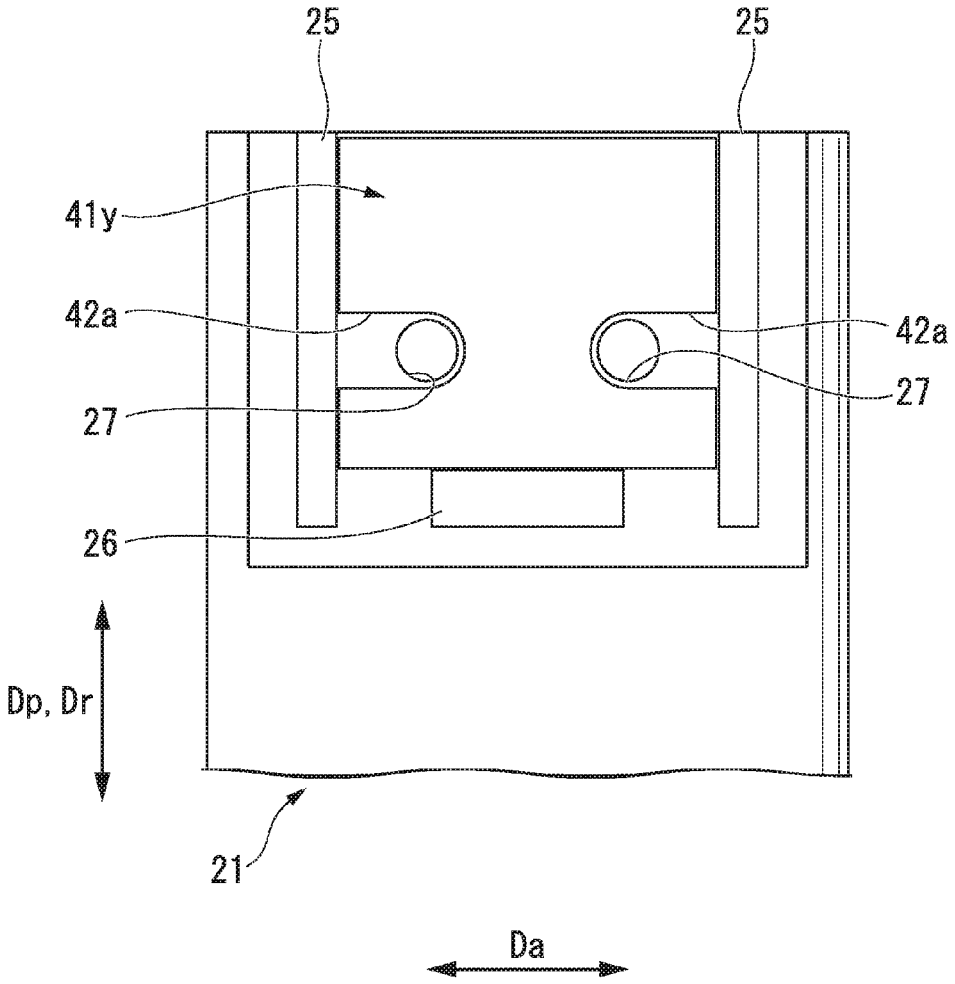
FIG. 18 is a front view of a liner according to a second modified example of the embodiment of the present invention.

The screw insertion portion 42 of the liner 41 in the embodiment is a hole formed in the liner 41. However, the screw insertion portion does not have to be a hole as long as the threaded portion 52 of the fixing screw 51 can be inserted thereinto. For example, as shown in FIGS. 17 and 18, screw insertion portions 42*a* may be cutouts formed in liners 41*x* and 41*y*. Similarly to the liner 41 in the embodiment, the dimensions of the liners 41*x* and 41*y* are preferably set such that the liners 41*x* and 41*y* can be disposed at positions other than the positions of the engaging portions 25 and 26 of the groove insertion portion 23 and the engaged portions 35 and 36 of the liner holders 31 when the liners are disposed between the groove insertion portion 23 of the pin 21 and the liner holders 31.

In the embodiment the engaging portions (the first engaging recesses 25 and the second engaging recesses 26) of the pin 21 are concave portions, and the engaged portions (the first engaged convex portions 35 and the second engaged convex portions 36) of the liner holders 31 are convex portions. However, to the contrary, the engaging portions of the pin 21 may be convex portions and the engaged portions of the liner holders 31 may be concave portions.

In this embodiment, the liners 41 are respectively disposed in the space between the first liner holder 31*a* and the groove insertion portion 23 of the pin 21 and the space between the second liner holder 31*b* and the groove insertion portion 23 of the pin 21. However, depending on the displacement in the horizontal direction Dh measured in the displacement measuring step (S3), the liner 41 may be disposed in only one space of the space between the first liner holder 31*a* and the groove insertion portion 23 of the pin 21 and the space between the second liner holder 31*b* and the groove insertion portion 23 of the pin 21.

In this embodiment, the pin holding screw 61 is used to prevent the pin 21 from dropping from the pin insertion hole 12. However, the head of the pin 21 may be welded to the half casing 11 without using the pin holding screw 61.

The positioning device 20 according to this embodiment determines the position of the half blade ring 6 as the inner member relative to the half casing 11 as the outer member. However, the present invention is not limited to this configuration. As long as the outer member extends in the circumferential direction Dc around the axis Ar, the outer member does not have to be the half casing 11. As long as the inner member is disposed on the inner circumferential side of the outer member and extends in the circumferential direction Dc around the axis Ar, the inner member does not need to be the half blade ring 6. The present invention may be applied to another rotary machine such as a gas turbine or a compressor other than the steam turbine.

According to an aspect of the present invention, it is possible to suppress an increase in the manufacturing cost of a positioning device.

REFERENCE SIGNS LIST

1 rotor (steam turbine rotor)
2 blade
5 blade ring
6 half blade ring (inner member)
6*x* upper-half blade ring (inner member)
6*y* lower-half blade ring (inner member)
7 pin groove
8 groove side surface
8*a* first groove side surface
8*b* second groove side surface
9 vane
10 casing
11 half casing (outer member)
11*x* upper-half casing (outer member)
11*y* lower-half casing (outer member)
12 pin insertion hole
13 flange receiving recess
14 female thread
20 positioning device
20*a* temporary positioning device
20*b* adjusted positioning device
21 pin
21*a* temporary pin
21*b* adjusted pin
22 insertion portion
23 groove insertion portion
23*c* side circumferential surface
24 liner contact surface
25 first engaging recess (engaging portion, first engaging portion)
26 second engaging recess (engaging portion, second engaging portion)
27 screw hole
28 head flange
29 seal groove
31 liner holder
31*a* first liner holder
31*b* second liner holder
32 groove contact surface
33 liner contact surface
34*a* first tapered surface
34*b* second tapered surface
35 first engaged convex portion (engaged portion, first engaged portion)
36 second engaged convex portion (engaged portion, second engaged portion)
37 screw insertion portion
38 screw head receiving recess
41, 41*x*, 41*y* liner
41*a* regular liner
42, 42*a* screw insertion portion
51 fixing screw (liner fitting)
52 threaded portion
53 screw head
55 seal member

61 pin holding screw
62 threaded portion
63 screw head
65 locking tool

The invention claimed is:

1. A positioning device that positions an inner member, which is disposed on an inner circumferential side of an outer member and extends in a circumferential direction around an axis, relative to the outer member, which extends in the circumferential direction around the axis, the positioning device comprising:

a pin that is inserted into a pin insertion hole and a groove, the pin insertion hole penetrating the outer member from an outer circumferential side of the outer member to the inner circumferential side of the outer member, and the groove being concave from an outer circumferential side of the inner member to an inner circumferential side of the inner member;

a liner holder that comes in contact with a groove side surface of the groove; and a liner that is disposed between the liner holder and the pin in the groove, wherein the pin includes an insertion portion that is inserted into the pin insertion hole of the outer member and a groove insertion portion that is inserted into the groove of the inner member;

the liner holder includes a first liner holder that is disposed between a first groove side surface of a pair of groove side surfaces facing each other in the groove and the groove insertion portion of the pin, and a second liner holder that is disposed between a second groove side surface of the pair of groove side surfaces and the groove insertion portion of the pin;

the liner is disposed in at least one space of a space between the groove insertion portion and the first liner holder and a space between the groove insertion portion and the second liner holder;

a pair of liner contact surfaces that face opposite sides and engaging portions having a concave shape or a convex shape with respect to the pair of liner contact surfaces are formed in the groove insertion portion of the pin; and a groove contact surface that comes in contact with the groove side surface, a liner contact surface that faces the opposite side from the side which the groove contact surface faces, and an engaged portion that has a convex shape or a concave shape with respect to the liner contact surface to engage with the engaging portion, are formed in the liner holder.

2. The positioning device according to claim 1, further comprising a liner fitting that fixes the liner holder and the liner to the groove insertion portion of the pin.

3. The positioning device according to claim 2, wherein the liner fitting is a fixing screw that includes a cylindrical threaded portion and a screw head disposed at an end of the threaded portion;

a screw hole into which the threaded portion of the fixing screw is screwed is formed in the groove insertion portion of the pin;

a screw insertion portion into which the threaded portion of the fixing screw is inserted is formed in the liner; and a screw insertion portion into which the threaded portion of the fixing screw is inserted, and a screw head receiving recess which communicates with the screw insertion portion and into which the screw head of the fixing screw is received are formed in the liner holder.

4. The positioning device according to claim 1, wherein the engaging portion of the pin includes a pair of first engaging portions that are concave or convex with respect to the liner contact surface of the pin, are long along the liner contact surface in an insertion direction in which the pin is inserted into the pin insertion hole, and are formed with a gap therebetween in a direction perpendicular to the insertion direction;

the engaged portion of the liner holder includes a pair of first engaged portions that are convex or concave with respect to the liner contact surface of the liner holder, are long in the insertion direction, are formed with a gap therebetween in the direction perpendicular to the insertion direction, and respectively engage with the pair of first engaging portions; and the liner is disposed between the pair of first engaging portions.

5. The positioning device according to claim 1, wherein the engaging portion of the pin includes a second engaging portion that is concave or convex with respect to the liner contact surface of the pin and is long along the liner contact surface in a direction perpendicular to an insertion direction in which the pin is inserted into the pin insertion hole; and the engaged portion of the liner holder includes a second engaged portion that is convex or concave with respect to the liner contact surface of the liner holder, is long in the direction perpendicular to the insertion direction, and engages with the second engaging portion.

6. The positioning device according to claim 1, wherein the liner is disposed at a position other than that of the engaging portion of the groove insertion portion and that of the engaged portion of the liner holder between the groove insertion portion of the pin and the liner holder.

7. The positioning device according to claim 1, wherein a concave portion that communicates with the pin insertion hole, has a diameter larger than that of the pin insertion hole, and is concave from the outer circumferential side of the outer member to the inner circumferential side is formed on the outer circumferential side of the outer member;

the positioning device further comprises a seal member that seals a space between the outer member and the pin;

the pin includes a head flange that is formed on the opposite side of the insertion portion from the groove insertion portion in an insertion direction in which the pin is inserted into the pin insertion hole, has a diameter larger than the diameter of the insertion portion, and is capable of being received in the concave portion; and the seal member is disposed between the head flange of the pin and a bottom surface of the concave portion.

8. The positioning device according to claim 1, wherein a concave portion that communicates with the pin insertion hole and is concave from the outer circumferential side of the outer member to the inner circumferential side is formed on the outer circumferential side of the outer member and a female thread is formed on the side circumferential surface of the concave portion; and the positioning device further comprises a pin holding screw that is screwed into the female thread and comes in contact with the head of the pin.

9. The positioning device according to claim 8, further comprising a locking tool that engages with a part of the pin holding screw, engages with a part of the outer member, and regulates rotation in a loosening direction of the pin holding screw from the female thread.

10. A rotary machine comprising:

the positioning device according to claim 1;

the outer member;

the inner member; and a rotor that is disposed on the inner circumferential side of the inner member and rotates around the axis.

11. The rotary machine according to claim 10, wherein the rotor is a steam turbine rotor.

12. A positioning device that positions an inner member, which is disposed on an inner circumferential side of an outer member and extends in a circumferential direction around an axis, relative to the outer member, which extends in the circumferential direction around the axis, the positioning device comprising:

a pin that is inserted into a pin insertion hole and a groove, the pin insertion hole penetrating the outer member from an outer circumferential side of the outer member to the inner circumferential side of the outer member, and the groove being concave from an outer circumferential side of the inner member to an inner circumferential side of the inner member;

a liner holder that comes in contact with a groove side surface of the groove; and a liner that is disposed between the liner holder and the pin in the groove, wherein the pin includes an insertion portion that is inserted into the pin insertion hole of the outer member and a groove insertion portion that is inserted into the groove of the inner member;

the liner holder includes a first liner holder that is disposed between a first groove side surface of a pair of groove side surfaces facing each other in the groove and the groove insertion portion of the pin, and a second liner holder that is disposed between a second groove side surface of the pair of groove side surfaces and the groove insertion portion of the pin;

the liner is disposed in at least one space of a space between the groove insertion portion and the first liner holder and a space between the groove insertion portion and the second liner holder;

the pin insertion hole of the outer member is a cylindrical hole;

the insertion portion of the pin has a cylindrical shape which is capable of being inserted into the pin insertion hole;

the groove insertion portion includes a side circumferential surface that is a circumferential surface extending from a part of an outer circumferential surface of the cylindrical insertion portion and a surface which is located inside a virtual outer circumferential surface extending from the outer circumferential surface of the insertion portion and to which the liner holder is fixed; and the liner holder is located inside the virtual outer circumferential surface when the liner holder is fixed to the groove insertion portion.

13. A positioning method of positioning an inner member, which is disposed on an inner circumferential side of an outer member and extends in a circumferential direction around an axis, relative to the outer member, which extends in the circumferential direction around the axis, the positioning method comprising:

a preparing step of preparing a positioning device including a pin that is inserted into a pin insertion hole penetrating the outer member from an outer circumferential side of the outer member to the inner circumferential side and a groove which is concave from an outer circumferential side of the inner member to an inner circumferential side, a liner holder that comes in contact with a groove side surface of the groove, and a liner that is disposed between the liner holder and the pin in the groove;

a temporary positioning step of temporarily positioning the inner member relative to the outer member using a temporary positioning device including a temporary pin that is inserted into the pin insertion hole of the outer member and the groove of the inner member;

a displacement measuring step of measuring a displacement of the temporarily-positioned inner member relative to the outer member;

an adjusted pin assembling step of assembling an adjusted pin which is adjusted by disposing the liner having a thickness corresponding to the displacement between the pin and the liner holder in the positioning device;

a temporary holding step of temporarily holding the inner member so as to be movable relative to the outer member;

a temporary position releasing step of extracting the temporary positioning device from the outer member and the temporarily-held inner member;

a positioning device attaching step of inserting the adjusted pin into the pin insertion hole of the outer member and the groove of the inner member; and a temporary hold releasing step of releasing the temporary holding of the inner member after the positioning device attaching step.

14. The positioning method according to claim 13, wherein the preparing step includes preparing a plurality of liners having different thicknesses as the liner; and the adjusted pin assembling step includes selecting the liner having the thickness corresponding to the displacement measured in the displacement measuring step out of the plurality of liners and disposing the selected liner between the pin and the liner holder.

15. The positioning method according to claim 13, wherein the preparing step includes preparing a seal member that seals a space between the outer member and the pin and a pin holding screw that is screwed into a position at which the pin insertion hole is formed in the outer member from the outer circumferential side of the outer member; and the positioning device attaching step includes sealing the space between the outer member and the pin with the seal member, inserting the adjusted pin into the pin insertion hole of the outer member and the groove of the inner member, screwing the pin holding screw into the position at which the pin insertion hole is formed in the outer member, and bringing the pin holding screw into contact with the adjusted pin.

* * * * *